US012305142B1

(12) United States Patent
Norris

(10) Patent No.: US 12,305,142 B1
(45) Date of Patent: May 20, 2025

(54) INDUSTRIAL LUBRICANT

(71) Applicant: Afton Chemical Corporation, Richmond, VA (US)

(72) Inventor: Paul Norris, Fareham (GB)

(73) Assignee: Afton Chemical Corporation, Richmond, VA (US)

( * ) Notice: Subject to any disclaimer, the term of this patent is extended or adjusted under 35 U.S.C. 154(b) by 0 days.

(21) Appl. No.: 18/581,572

(22) Filed: Feb. 20, 2024

(51) Int. Cl.

| | |
|---|---|
| ***C10M 137/12*** | (2006.01) |
| ***C10M 137/10*** | (2006.01) |
| ***C10M 149/02*** | (2006.01) |
| ***C10M 161/00*** | (2006.01) |
| ***C10M 169/04*** | (2006.01) |
| *C10N 30/00* | (2006.01) |
| *C10N 30/06* | (2006.01) |
| *C10N 30/12* | (2006.01) |
| *C10N 40/04* | (2006.01) |

(52) U.S. Cl.
CPC .... *C10M 169/044* (2013.01); *C10M 137/105* (2013.01); *C10M 137/12* (2013.01); *C10M 149/02* (2013.01); *C10M 161/00* (2013.01); *C10M 2203/003* (2013.01); *C10M 2217/06* (2013.01); *C10M 2223/047* (2013.01); *C10M 2223/06* (2013.01); *C10N 2030/06* (2013.01); *C10N 2030/12* (2013.01); *C10N 2030/45* (2020.05); *C10N 2040/04* (2013.01)

(58) Field of Classification Search
CPC ..... C10M 169/044; C10M 137/105; C10M 137/12; C10M 149/02; C10M 161/00; C10M 2203/003; C10M 2217/06; C10M 2223/047; C10M 2223/06; C10N 2030/06; C10N 2030/12; C10N 2030/45; C10N 2040/04
USPC ..... 508/294
See application file for complete search history.

(56) References Cited

U.S. PATENT DOCUMENTS

| | | | |
|---|---|---|---|
| 2,237,625 | A | 4/1941 | Olin |
| 2,237,627 | A | 4/1941 | Olin |
| 2,527,948 | A | 10/1950 | Lyon et al. |
| 2,695,316 | A | 11/1954 | McBride |
| 2,995,569 | A | 8/1961 | Hamilton et al. |
| 3,022,351 | A | 2/1962 | Mihm et al. |
| 3,178,663 | A | 4/1965 | Kahn |
| 3,185,647 | A | 5/1965 | Anderson et al. |
| 3,189,544 | A | 6/1965 | Ratner et al. |
| 3,219,666 | A | 11/1965 | Normal et al. |
| 3,256,185 | A | 6/1966 | Le Suer |
| 3,278,550 | A | 10/1966 | Norman et al. |
| 3,308,166 | A | 3/1967 | Michel et al. |
| 3,312,619 | A | 4/1967 | Vineyard |
| 3,366,569 | A | 1/1968 | Norman et al. |
| 3,390,086 | A | 6/1968 | O'Halloran |
| 3,392,201 | A | 7/1968 | Warner |
| 3,403,102 | A | 9/1968 | Le Suer |
| 3,458,530 | A | 7/1969 | Siegel et al. |
| 3,470,098 | A | 9/1969 | O'Halloran |
| 3,471,404 | A | 10/1969 | Myers |
| 3,502,677 | A | 3/1970 | Le Sner |
| 3,519,564 | A | 7/1970 | Vogel |
| 3,546,243 | A | 12/1970 | Coupland |
| 3,565,804 | A | 2/1971 | Honnen et al. |
| 3,573,205 | A | 3/1971 | Lowe et al. |
| 3,634,515 | A | 1/1972 | Piasek et al. |
| 3,649,229 | A | 3/1972 | Otto |
| 3,673,090 | A | 6/1972 | Waldbillig et al. |
| 3,697,574 | A | 10/1972 | Piasek et al. |
| 3,703,504 | A | 11/1972 | Horodysky |
| 3,703,505 | A | 11/1972 | Horodysky et al. |
| 3,708,522 | A | 1/1973 | Le Suer |
| 3,736,357 | A | 5/1973 | Piasek et al. |
| 3,749,695 | A | 7/1973 | de Vries |
| 3,796,661 | A | 3/1974 | Suratwala et al. |
| 3,859,318 | A | 1/1975 | Lesuer |
| 3,865,740 | A | 2/1975 | Goldschmidt |
| 3,865,813 | A | 2/1975 | Gergel |
| 3,873,454 | A | 3/1975 | Horodysky et al. |
| 3,954,639 | A | 5/1976 | Liston |
| 4,119,549 | A | 10/1978 | Davis |
| 4,119,550 | A | 10/1978 | Davis et al. |
| 4,147,640 | A | 4/1979 | Jayne et al. |
| 4,152,499 | A | 5/1979 | Boerzel et al. |
| 4,191,659 | A | 3/1980 | Davis |
| 4,204,969 | A | 5/1980 | Papay et al. |
| 4,218,332 | A | 8/1980 | Schwab et al. |
| 4,234,435 | A | 11/1980 | Meinhardt et al. |
| 4,240,958 | A | 12/1980 | Braid |

(Continued)

FOREIGN PATENT DOCUMENTS

| | | | |
|---|---|---|---|
| EP | 0608018 | A1 | 7/1994 |
| EP | 0612839 | A1 | 8/1994 |

(Continued)

OTHER PUBLICATIONS

Caterpillar Inc, "Tansmission and Drive Train Fluid Requirements." Specification T0-4 (Jun. 23, 2005): 1-44.
W. W. Yau, J. J. Kirkland and D. D. Bly, "Modern Size Exclusion Liquid Chromatography", John Wiley and Sons, New York, 1979.

*Primary Examiner* — Prem C Singh
*Assistant Examiner* — Francis C Campanell
(74) *Attorney, Agent, or Firm* — Honigman LLP

(57) ABSTRACT

A lubricating composition for a transmission, gearbox, or clutches including a mixture of compounds providing phosphorus and nitrogen to the fluids effective to achieve good wear, extreme pressure, friction, and copper corrosion.

20 Claims, No Drawings

(56) References Cited

U.S. PATENT DOCUMENTS

| | | | |
|---|---|---|---|
| 4,259,194 | A | 3/1981 | deVries et al. |
| 4,259,195 | A | 3/1981 | King et al. |
| 4,261,843 | A | 4/1981 | King et al. |
| 4,263,152 | A | 4/1981 | King et al. |
| 4,265,773 | A | 5/1981 | deVries et al. |
| 4,272,387 | A | 6/1981 | King et al. |
| 4,283,295 | A | 8/1981 | deVries et al. |
| 4,285,822 | A | 8/1981 | deVries et al. |
| 4,344,854 | A | 8/1982 | Davis et al. |
| 4,379,064 | A | 4/1983 | Cengel et al. |
| 4,472,306 | A | 9/1984 | Powers, III et al. |
| 4,482,464 | A | 11/1984 | Karol et al. |
| 4,521,318 | A | 6/1985 | Karol |
| 4,554,086 | A | 11/1985 | Karol et al. |
| 4,564,709 | A | 1/1986 | Koyama et al. |
| 4,579,675 | A | 4/1986 | Sawicki et al. |
| 4,612,132 | A | 9/1986 | Wollenberg et al. |
| 4,614,522 | A | 9/1986 | Buckley |
| 4,614,603 | A | 9/1986 | Wollenberg |
| 4,617,137 | A | 10/1986 | Plavac |
| 4,617,138 | A | 10/1986 | Wollenberg |
| 4,636,322 | A | 1/1987 | Nalesnik |
| 4,645,515 | A | 2/1987 | Wollenberg |
| 4,646,860 | A | 3/1987 | Owens et al. |
| 4,647,390 | A | 3/1987 | Buckley, III et al. |
| 4,648,886 | A | 3/1987 | Buckley, III et al. |
| 4,648,980 | A | 3/1987 | Erdman |
| 4,652,387 | A | 3/1987 | Andress, Jr. et al. |
| 4,663,062 | A | 5/1987 | Wollenberg |
| 4,663,064 | A | 5/1987 | Nalesnik et al. |
| 4,666,459 | A | 5/1987 | Wollenberg |
| 4,666,460 | A | 5/1987 | Wollenberg |
| 4,668,246 | A | 5/1987 | Wollenberg |
| 4,670,170 | A | 6/1987 | Wollenberg |
| 4,699,724 | A | 10/1987 | Nalesnik et al. |
| 4,711,736 | A | 12/1987 | Horodysky et al. |
| 4,713,189 | A | 12/1987 | Nalesnik et al. |
| 4,713,191 | A | 12/1987 | Nalesnik |
| 4,795,576 | A | 1/1989 | Born et al. |
| 4,857,214 | A | 8/1989 | Papay et al. |
| 4,943,672 | A | 7/1990 | Hamner et al. |
| 4,948,386 | A | 8/1990 | Sung et al. |
| 4,954,274 | A | 9/1990 | Zaweski et al. |
| 4,963,275 | A | 10/1990 | Gutierrez et al. |
| 4,963,278 | A | 10/1990 | Blain et al. |
| 4,966,720 | A | 10/1990 | DeGonia et al. |
| 4,971,598 | A | 11/1990 | Andress et al. |
| 4,971,711 | A | 11/1990 | Lundberg et al. |
| 4,973,412 | A | 11/1990 | Migdal et al. |
| 4,981,492 | A | 1/1991 | Blain et al. |
| 5,026,495 | A | 6/1991 | Emert et al. |
| 5,030,249 | A | 7/1991 | Herbstman et al. |
| 5,039,307 | A | 8/1991 | Herbstman et al. |
| 5,075,383 | A | 12/1991 | Migdal et al. |
| 5,241,003 | A | 8/1993 | Degonia et al. |
| 5,266,223 | A | 11/1993 | Song et al. |
| 5,334,321 | A | 8/1994 | Harrison et al. |
| 5,344,579 | A | 9/1994 | Ohtani et al. |
| 5,627,259 | A | 5/1997 | Thaler et al. |
| 5,633,326 | A | 5/1997 | Patil et al. |
| 5,643,859 | A | 7/1997 | Gutierrez et al. |
| 5,650,381 | A | 7/1997 | Gatto et al. |
| 5,739,355 | A | 4/1998 | Gateau et al. |
| 5,792,729 | A | 8/1998 | Harrison et al. |
| 5,851,965 | A | 12/1998 | Harrison et al. |
| 5,853,434 | A | 12/1998 | Harrison et al. |
| 5,882,505 | A | 3/1999 | Wittenbrink et al. |
| 5,888,945 | A | 3/1999 | Stiefel et al. |
| 5,936,041 | A | 8/1999 | Diana et al. |
| 6,010,987 | A | 1/2000 | Stiefel et al. |
| 6,013,171 | A | 1/2000 | Cook et al. |
| 6,080,301 | A | 6/2000 | Berlowitz et al. |
| 6,096,940 | A | 8/2000 | Wittenbrink et al. |
| 6,103,099 | A | 8/2000 | Wittenbrink et al. |
| 6,107,257 | A | 8/2000 | Valcho et al. |
| 6,165,949 | A | 12/2000 | Berlowitz et al. |
| 6,180,575 | B1 | 1/2001 | Nipe |
| RE37,363 | E | 9/2001 | Gatto et al. |
| 6,723,685 | B2 | 4/2004 | Hartley et al. |
| RE38,929 | E | 1/2006 | Gatto et al. |
| 7,214,649 | B2 | 5/2007 | Loper et al. |
| 7,253,231 | B2 | 8/2007 | Devlin et al. |
| 7,368,596 | B2 | 5/2008 | Thomson et al. |
| RE40,595 | E | 12/2008 | Gatto et al. |
| 7,485,603 | B2 | 2/2009 | Bera et al. |
| 7,645,726 | B2 | 1/2010 | Loper |
| 7,732,390 | B2 | 6/2010 | Kadkhodayan et al. |
| 7,786,057 | B2 | 8/2010 | Bera et al. |
| 7,897,696 | B2 | 3/2011 | Huang et al. |
| 8,048,831 | B2 | 11/2011 | Loper |
| 8,076,275 | B2 | 12/2011 | Ruhe, Jr. et al. |
| 8,703,679 | B2 | 4/2014 | Li et al. |
| 9,481,696 | B1 | 11/2016 | Edwards et al. |
| 10,023,824 | B2 | 7/2018 | Bender |
| 11,149,266 | B2 | 10/2021 | Melosh et al. |
| 11,214,750 | B2 | 1/2022 | Milner |
| 11,639,480 | B1 | 5/2023 | Baker |
| 2012/0101017 | A1 | 4/2012 | Duggal |
| 2013/0096041 | A1* | 4/2013 | Matray ..... C10M 141/10 508/272 |
| 2016/0281020 | A1 | 9/2016 | Yamamoto et al. |
| 2018/0002631 | A1 | 1/2018 | Milner |
| 2019/0002789 | A1 | 1/2019 | Boffa et al. |
| 2019/0264124 | A1 | 8/2019 | Narita |
| 2019/0390134 | A1 | 12/2019 | Chommeloux et al. |
| 2020/0318025 | A1 | 10/2020 | Sampler et al. |
| 2020/0354647 | A1 | 11/2020 | Schwaebisch et al. |
| 2020/0377817 | A1 | 12/2020 | Sampler et al. |

FOREIGN PATENT DOCUMENTS

| | | | |
|---|---|---|---|
| EP | 2570471 | A1 | 3/2013 |
| EP | 2789679 | A1 | 10/2014 |
| GB | 1065595 | A | 4/1967 |
| GB | 1162334 | A | 8/1969 |
| GB | 2140811 | A | 12/1984 |
| GB | 2440811 | A | 2/2008 |
| WO | 9406897 | A1 | 3/1994 |
| WO | 2008124386 | A2 | 10/2008 |

* cited by examiner

INDUSTRIAL LUBRICANT

TECHNICAL FIELD

The present disclosure relates to industrial lubricants, and more particularly to lubricating compositions for transmissions, gearboxes, and/or clutches.

BACKGROUND

Industrial gearboxes and transmissions are integral components of a wide variety of heavy-duty machinery, such as mining equipment, oil rigs, material handling systems, and equipment used in manufacturing plant operations to suggest but a few applications. These gear systems operate under severe conditions, high loads, elevated temperatures, and/or extreme pressures often leading to increased wear and tear, reduced efficiency, and premature failure. Efficient lubrication of these gear systems protects against wear and extends equipment life.

As original equipment manufacturer (OEM) requirements evolve, prior industrial gear and transmission lubricants often fall short in providing adequate protection and durability under the more demanding operating conditions, and wider range of end uses demanded by newer requirements and applications. Existing products face challenges with roller bearing protection, gear wear, material compatibility, and/or often fall short when seeking to balance wear protection with higher friction applications (e.g., clutches and/or clutch brakes) often demanded in such new applications. For instance, newer transmission and gearbox lubricating composition are regularly required to achieve a number of key properties at the same time including one or more of wear prevention, extreme pressure protection, corrosion reduction and/or friction performance. Such new lubricants often need to meet or exceed multiple performance tests all at the same time including: wear protection as measured by a 4-ball wear test (ASTM D4172), extreme pressure properties pursuant to a 4-ball load wear index (ASTM D2783), friction performance measured pursuant a high frequency reciprocating rig (HFRR), and achieve low copper corrosion (ASTM D130). It has previously been challenging to design a transmission and gearbox lubricant that can meet all four requirements at the same time because formulating a lubricant to meet one or two of such performance tests tended to fail the others.

SUMMARY

In one approach or embodiment, a lubricating composition is provided herein and wherein the lubricating composition is configured to lubricant, for instance, a transmission, a gearbox, and/or a clutch. In aspects, the lubricating composition includes at least (i) a base oil of lubricating viscosity; (ii) an amount of phosphorus provided from three phosphorus compounds including (iia) a first phosphorus compound including an ashless, dialkyl dithiophosphate of Formula I, or a salt thereof:

(Formula I)

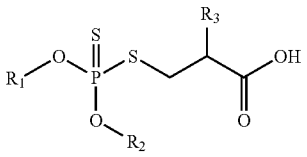

wherein $R_1$ and $R_2$ are, independently, a C3 to C8 linear or branched alkyl group, and $R_3$ is hydrogen or a methyl group; (iib) a second phosphorus compound including an amino alkyl phosphonate of Formula II or cyclic derivatives thereof:

(Formula II)

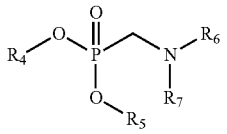

wherein $R_4$ and $R_5$ are, independently, a C1 to C4 linear or branched alkyl group, and $R_6$ and $R_7$ are, independently a C1 to C4 hydroxyalkyl group; and (iic) a third phosphorus compound including a hydrocarbyl phosphonate monoester of Formula III:

(Formula III)

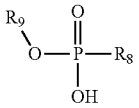

wherein $R_8$ is a C12 to C30 hydrocarbyl group and $R_9$ is a methyl group, an ethyl group, a propyl group, or an isopropyl group; and wherein the first, the second, and the third phosphorus compounds provide a total of about 30 ppm to about 200 ppm phosphorus to the lubricating composition; (iii) an amount of nitrogen provided by a nitrogen-containing polyisobutylene succinimide with a number average molecular weight of the polyisobutylene substituent of about 500 to about 2500 g/mol when determined by gel permeation chromatography using polystyrene as a standard and providing about 30 ppm to about 105 ppm weight percent of nitrogen to the lubricating composition.

In other approaches or embodiments, the lubricating composition of the previous paragraph may include other features or embodiments in any combination. These other features or embodiments include one or more of the following: wherein the first phosphorus compound is 3-[[bis(2-methylpropoxy)phosphinothioyl]thio]-2-methyl-propanoic acid; and/or wherein the first phosphorus compound provides about 5 to about 75 ppm of phosphorus to the lubricating composition; and/or wherein the second phosphorus compound is N,N-bis(2-hydroxylethyl) aminomethyl phosphonic acid diethyl ester; and/or wherein the second phosphorus compound provides about 10 to about 65 ppm of phosphorus to the lubricating composition; and/or wherein the third phosphorus compound is methyl octadecyl phosphonate; and/or wherein the third phosphorus compound provides about 5 to about 40 ppm of phosphorus to the lubricating composition; and/or wherein the first phosphorus compound provides about 5 ppm to about 75 ppm of phosphorus to the lubricating composition, the second phosphorus compound provides about 10 to about 65 ppm of phosphorus to the lubricating composition, and the third phosphorus compound provides about 5 to about 40 ppm of phosphorus to the lubricating composition; and/or wherein the lubricating composition exhibits a mean wear scar of about 0.5 mm or less pursuant to ASTM D4172 (40 kgf), a load wear index of about 46 or greater pursuant to ASTM D2783, a friction coefficient as measured using a high frequency reciprocating rig (HFRR) of greater than about 0.128 when using a 400 gram load, 20 Hz, 80° C. for 3 minutes, and a copper corrosion tarnishing rating of 2b or better when evaluated pursuant to ASTM D130 for 3 hours at 100° C.; and/or wherein about 30 to about 45 weight percent of the total phosphorus is provided by the first phosphorus compound, about 35 to about 40 weight percent of the total phosphorus is provided by the second phosphorus compound, and about 20 to about 30 weight percent of the total phosphorus is provided by the third phosphorus compound; and/or wherein greater than 50 weight percent of the phosphorus is provided by the second and third phosphorus compounds combined; and/or wherein the lubricating composition has a KV100 of about 5 to about 60 cSt; and/or wherein the lubricating composition has a ratio of phosphorus from the three phosphorus compounds to nitrogen from the nitrogen-substituted long chain alkenyl succinimide of about 1:1 to about 2.2:1; and/or wherein the nitrogen-substituted long chain alkenyl succinimide includes compounds having a structure of Formula IV:

(Formula IV)

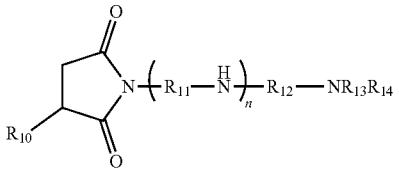

wherein $R_{10}$ is a polyisobutylene having a number average molecular weight of about 500 to about 1200 g/mol; $R_{11}$ and $R_{12}$ are, independently, a divalent $C_1$-$C_6$ alkylene; each of $R_{13}$ and $R_{14}$, independently, is hydrogen, $C_1$-$C_6$ alkyl, or together with the N to which they are attached form a 5- or 6-membered ring optionally fused with one or more aromatic or non-aromatic rings; and n is an integer from 0 to 8; and/or wherein $R_{13}$ and $R_{14}$ together with the N to which they are attached form a succinimide moiety of Formula V (Formula V)

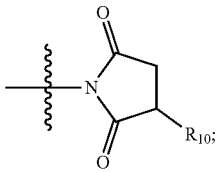

and/or wherein each of $R_{11}$ and $R_{12}$ are C2 alkylene and n is an integer of 2.

In another approach or embodiment, methods of lubricating a transmission, a gearbox, and/or a clutch are provided herein. In aspects, the methods include lubricating a transmission, a gearbox, and/or a clutch component with a lubricating composition; and wherein the lubricating composition includes (i) a base oil of lubricating viscosity; (ii) an amount of phosphorus provided from three phosphorus compounds including (iia) a first phosphorus compound including an ashless, dialkyl dithiophosphate of Formula I, or a salt thereof:

(Formula I)

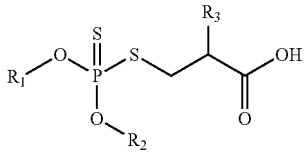

wherein $R_1$ and $R_2$ are, independently, a C3 to C8 linear or branched alkyl group, and $R_3$ is hydrogen or a methyl group; (iib) a second phosphorus compound including an amino alkyl phosphonate of Formula II or cyclic derivatives thereof:

(Formula II)

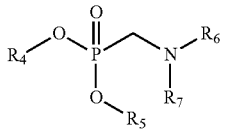

wherein $R_4$ and $R_5$ are, independently, a C1 to C4 linear or branched alkyl group, and $R_6$ and $R_7$ are, independently a C1 to C4 hydroxyalkyl group; and (iic) a third phosphorus compound including a hydrocarbyl phosphonate monoester of Formula III:

(Formula III)

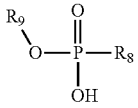

wherein $R_8$ is a $C_{12}$ to $C_{30}$ hydrocarbyl group and $R_9$ is a methyl group, an ethyl group, a propyl group, or an isopropyl group; and wherein the first, the second, and the third phosphorus compounds provide a total of about 30 ppm to about 200 ppm phosphorus to the lubricating composition; (iii) an amount of nitrogen provided by a nitrogen-containing polyisobutylene succinimide with a number average molecular weight of the polyisobutylene substituent of about 500 to about 2,500 g/mol when determined by gel permeation chromatography using polystyrene as a standard and providing about 30 ppm to about 105 ppm weight percent of nitrogen to the lubricating composition.

In yet further approaches or embodiments, the method described in the previous paragraph may include other features, steps, or embodiments in any combination. These other features, steps, or embodiments include one or more of the following: wherein the first phosphorus compound is 3-[[bis(2-methylpropoxy)phosphinothioyl]thio]-2-methylpropanoic acid; and/or wherein the first phosphorus compound provides about 5 to about 75 ppm of phosphorus to the lubricating composition; and/or wherein the second phosphorus compound is N,N-bis(2-hydroxylethyl)aminomethyl phosphonic acid diethyl ester; and/or wherein the second phosphorus compound provides about 10 to about 65 ppm of phosphorus to the lubricating composition; and/or wherein the third phosphorus compound is methyl octadecyl phosphonate; and/or wherein the third phosphorus compound provides about 5 to about 40 ppm of phosphorus to the lubricating composition; and/or wherein the first phosphorus compound provides about 5 ppm to about 75 ppm of phosphorus to the lubricating composition, the second phosphorus compound provides about 10 to about 65 ppm of phosphorus to the lubricating composition, and the third phosphorus compound provides about 5 to about 40 ppm of phosphorus to the lubricating composition; and/or wherein the lubricating composition exhibits a mean wear scar of about 0.5 mm or less pursuant to ASTM D4172 (40 kgf), a load wear index of about 46 or greater pursuant to ASTM D2783, a friction coefficient as measured using a high frequency reciprocating rig (HFRR) of greater than about 0.128 when using a 400 gram load, 20 Hz, 80° C. for 3 minutes, and a copper corrosion tarnishing rating of 2b or better when evaluated pursuant to ASTM D130 for 3 hours at 100° C.; and/or wherein about 30 to about 45 weight percent of the total phosphorus is provided by the first phosphorus compound, about 35 to about 40 weight percent of the total phosphorus is provided by the second phosphorus compound, and about 20 to about 30 weight percent of the total phosphorus is provided by the third phosphorus compound; and/or wherein greater than 50 weight percent of the phosphorus is provided by the second and third phosphorus compounds combined; and/or wherein the lubricating composition has a KV100 of about 5 to about 60 cSt; and/or wherein the lubricating composition has a ratio of phosphorus from the three phosphorus compounds to nitrogen from the nitrogen-substituted long chain alkenyl succinimide of about 1:1 to about 2.2:1; and/or wherein the nitrogen-substituted long chain alkenyl succinimide includes compounds having a structure of Formula IV:

(Formula IV)

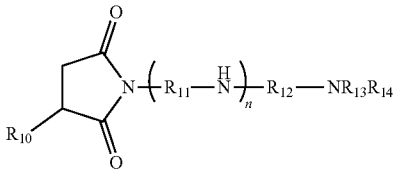

wherein $R_{10}$ is a polyisobutylene having a number average molecular weight of about 500 to about 1200 g/mol; $R_{11}$ and $R_{12}$ are, independently, a divalent $C_1$-$C_6$ alkylene; each of $R_{13}$ and $R_{14}$, independently, is hydrogen, $C_1$-$C_6$ alkyl, or together with the N to which they are attached form a 5- or 6-membered ring optionally fused with one or more aromatic or non-aromatic rings; and n is an integer from 0 to 8; and/or wherein $R_{13}$ and $R_{14}$ together with the N to which they are attached form a succinimide moiety of Formula V (Formula V)

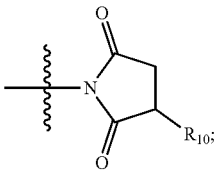

and/or wherein each of $R_{11}$ and $R_{12}$ are C2 alkylene and n is an integer of 2.

In yet other approaches or embodiments, the use of any embodiment of the lubricating composition as described above in this Summary for lubricating a transmission, a gearbox, and/or a clutch and achieving a mean wear scar of about 0.5 mm or less pursuant to ASTM D4172 (40 kgf), a load wear index of about 46 or greater pursuant to ASTM D2783, a friction coefficient as measured using a high frequency reciprocating rig (HFRR) of greater than about 0.128 when using a 400 gram load, 20 Hz, 80° C. for 3 minutes, and a copper corrosion tarnishing rating of 2b or better when evaluated pursuant to ASTM D130 for 3 hours at 100° C. is also described herein.

Other embodiments of the present disclosure will be apparent to those skilled in the art from consideration of the specification and practice of the invention disclosed herein. The following definitions of terms are provided in order to clarify the meanings of certain terms as used herein.

DETAILED DESCRIPTION

Disclosed herein are lubricating compositions suitable for gear fluids, transmission fluids, power transmission fluids, and/or driveline applications that achieve good performance in wear, extreme pressure, friction, and copper corrosion all at the same time. In one approach or embodiment, the lubricating compositions herein include a base oil of lubricating viscosity, select amounts of phosphorus from three specific phosphorus compounds, and an amount of nitrogen provided from a certain nitrogen-containing polyisobutylene succinimide. In approaches, the three phosphorus-containing compounds provide a total of about 30 ppm to about 200 ppm phosphorus to the lubricating composition and the nitrogen-containing polyisobutylene succinimide provides about 30 to about 105 ppm of nitrogen. As shown in the Examples below, only when all four compounds are included together in the lubricant (e.g., the three phosphorus compounds and the nitrogen-containing polyisobutylene succinimide) does the lubricant pass all four performance testing for wear (ASTM D4172), extreme pressure (ASTM D2783), friction (HFRR), and copper corrosion (ASTM D130) suitable for industrial gear lubricants.

In one approach or embodiment, the three phosphorus-containing compounds of the lubricants herein include (1) an ashless, dialkyl dithiophosphate, (2) an amino alkyl phosphonate, and (3) a hydrocarbyl phosphonate monoester. The first phosphorus compound of the lubricants herein is an ashless, dialkyl dithiophosphate of Formula I, or a salt thereof:

(Formula I)

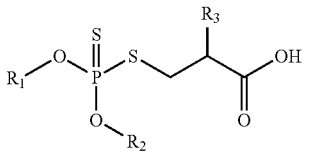

wherein $R_1$ and $R_2$ are, independently, a C3 to C8 linear or branched alkyl group, and $R_3$ is hydrogen or a methyl group. The second phosphorus compound of the lubricants herein is an amino alkyl phosphonate of Formula II or cyclic derivatives thereof:

(Formula II)

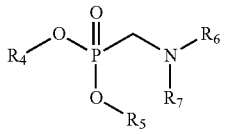

wherein $R_4$ and $R_5$ are, independently, a C1 to C4 linear or branched alkyl group, and $R_6$ and $R_7$ are, independently a C1 to C4 hydroxyalkyl group. The third phosphorus compound of the lubricants herein is a hydrocarbyl phosphonate monoester of Formula III:

(Formula III)

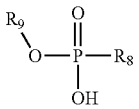

wherein $R_8$ is a $C_{12}$ to $C_{30}$ hydrocarbyl group and $R_9$ is a methyl group, an ethyl group, a propyl group, or an isopropyl group.

In another approach or embodiment, the nitrogen-containing polyisobutylene succinimide of the lubricants herein is a polyisobutylene substituted succinimide having a number average molecular weight of the polyisobutylene substituent of about 500 to about 2500 g/mol, and more specifically, is a nitrogen-substituted long chain alkenyl succinimide including one or more compounds having a structure of Formula IV:

(Formula IV)

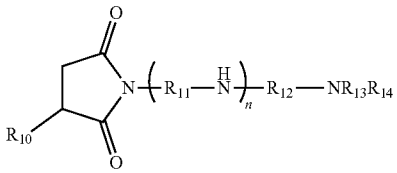

wherein $R_{10}$ is a polyisobutylene having a number average molecular weight of about 500 to about 2,500 g/mol (in other approaches, about 500 to about 1,200 g/mol), $R_{11}$ and $R_{12}$ are, independently, a divalent $C_1$-$C_6$ alkylene, each of $R_{13}$ and $R_{14}$, independently, is hydrogen, $C_1$-$C_6$ alkyl, or together with the N to which they are attached form a 5- or 6-membered ring optionally fused with one or more aromatic or non-aromatic rings; and n is an integer from 0 to 8.

Each phosphorus compound and nitrogen compound will be discussed further below.

First Phosphorus Compound

In approaches or embodiments, the first phosphorus compound of the lubricating compositions and methods herein is an acidic thiophosphate or a thiophosphate ester, such as an ashless, amine free dialkyl dithiophosphate acid ester or sulfur-containing phosphoric acid ester. The first phosphorus compound includes about 8 to about 10 weight percent phosphorus and provides about 7 ppm to about 75 ppm of phosphorus to the lubricating composition (in other approaches, about 10 ppm to about 50 ppm of phosphorus, in further approaches, about 15 ppm to about 40 ppm, or in yet other approaches, about 20 ppm to about 30 ppm of phosphorus). In alternative approaches, the lubricating compositions herein include about 0.01 weight percent to about 0.075 weight percent of the first phosphorus compound (in other approaches, about 0.015 weight percent to about 0.05 weight percent, in further approaches, about 0.02 weight percent to about 0.04 weight percent, or in yet other approaches, about 0.03 weight percent to about 0.04 weight percent of the first phosphorus compound).

In other approaches or embodiments, the first phosphorus compound provides phosphorus to the lubricating composition in an amount ranging from at least about 7 ppm, at least about 10 ppm, at least about 12 ppm, at least about 15 ppm, or at least about 20 ppm to about 75 ppm or less, about 70 ppm or less, about 60 ppm or less, about 50 ppm or less, about 40 ppm or less, or about 30 ppm or less (or any ranges between such endpoints). In yet other approaches, the treat rate of the first phosphorus compound in the lubricating composition may range from at least about 0.01 weight percent, at least about 0.02 weight percent, at least about 0.03 weight percent to about 0.075 weight percent or less, about 0.07 weight percent or less, about 0.06 weight percent or less, about 0.05 weight percent or less, or about 0.04 weight percent or less (or any ranges between such endpoints).

The acidic thiophosphate, the thiophosphate ester, or the sulfur-containing phosphoric acid esters of the first phosphorus compound may have one or more sulfur to phosphorus bonds. In an embodiment, the sulfur-containing phosphorus acid ester may be an acidic thiophosphate, a thiophosphate ester, a thiophosphorus acid or salt thereof. The thiophosphorus acid esters may be dithiophosphorus acid esters. In some more specific approaches, the acidic thiophosphate or thiophosphate ester may have a structure of Formula II or a salt thereof (Formula I)

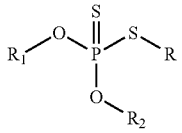

wherein $R_1$ and $R_2$ are each, independently, a linear or branched C1 to C10 hydrocarbyl group and R is a C1 to C10 linear or branched carboxylic group or a C1 to C10 linear or branched alkyl alkanoate group. More specifically, $R_1$ and $R_2$ are each a C3 to C8 linear or branched alkyl group and R is derived from 2-methyl proponoic acid such that the first phosphorus compound (or a salt thereof) has the structure of Formula Ia below:

(Formula Ia)

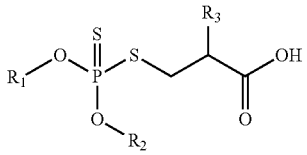

wherein $R_1$ and $R_2$ are, independently, a C3 to C8 linear or branched alkyl group (preferably, each are a branched C4 group), and $R_3$ is —H or —$CH_3$ (preferably a methyl group). In some approaches or embodiments, the first phosphorus product is preferably 3-[[bis(2-methylpropoxy)phosphinothioyl]thio]-2-methyl-propanoic acid.

Second Phosphorus Compound

In approaches or embodiments, the second phosphorus compound of the lubricating compositions and methods herein includes an amino alkyl phosphonate such as an aminoalkyl phosphonic acid dialkyl ester or cyclic derivatives thereof. In other approaches or embodiments, the second phosphorus compound includes about 11 to about 13 weight percent phosphorus, and provides about 10 ppm to about 65 ppm of phosphorus to the lubricating composition (in other approaches, about 12 ppm to about 50 ppm of phosphorus, in further approaches, about 14 ppm to about 30 ppm, or in yet other approaches, about 14 ppm to about 25 ppm of phosphorus). In alternative approaches, the lubricating compositions herein include about 0.01 weight percent to about 0.05 weight percent of the second phosphorus compound (in other approaches, about 0.011 weight percent to about 0.04 weight percent, in further approaches, about 0.012 weight percent to about 0.03 weight percent, or in yet other approaches, about 0.014 weight percent to about 0.02 weight percent of the second phosphorus compound).

In other approaches or embodiments, the second phosphorus compound provides phosphorus to the lubricating composition in an amount ranging from at least about 10 ppm, at least about 12 ppm, at least about 14 ppm, or at least about 15 ppm to about 65 ppm or less, about 60 ppm or less, about 50 ppm or less, about 40 ppm or less, or about 30 ppm or less (or any ranges between such endpoints). In yet other approaches, the treat rate of the second phosphorus compound in the lubricating composition may range from at least about 0.01 weight percent, at least about 0.012 weight percent, at least about 0.014 weight percent to about 0.05 weight percent or less, about 0.04 weight percent or less, about 0.03 weight percent or less, or about 0.02 weight percent or less (or any ranges between such endpoints).

In approaches or embodiments, the second phosphorus compound is an amino alkyl phosphonate of Formula II or cyclic derivatives thereof:

(Formula II)

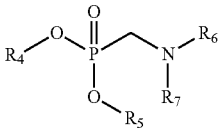

wherein $R_4$ and $R_5$ are, independently, a C1 to C4 linear or branched alkyl group, and $R_6$ and $R_7$ are, independently a C1 to C4 hydroxyalkyl group.

This second phosphorus compound can be prepared from a phosphite, formaldehyde, and an amine. An exemplary reaction scheme to form the second phosphorus compound is shown below using diethyl phosphite, diethanolamine, and formaldehyde as exemplary reactants:

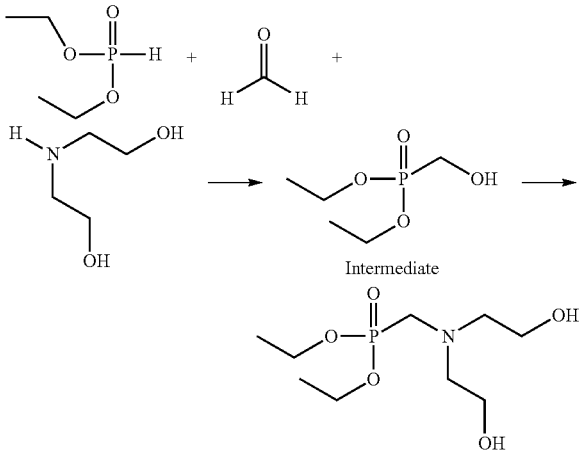

As shown, the reaction scheme utilizes an intermediate compound, and the resulting amino alkyl phosphonate may also include residual amounts of this intermediate (e.g., about 20 weight percent or less, about 10 weight percent or less, or about 5 weight percent or less, or about 2 weight percent or less, about 1 weight percent or less, or no detectable amounts). Water is a byproduct of this reaction, which is not shown in the scheme above. Other compounds of Formula II can be prepared in a similar fashion using appropriate reactants.

In some approaches, the compound of Formula II herein may also include cyclic derivatives thereof, such as those of Formula IIa below where R' is a C1 to C4 alkylene groups.

(Formula II)

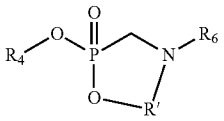

In some approaches, the second phosphorus compound is N,N-bis(2-hydroxylethyl) aminomethylphosphonic acid diethyl ester, and in other embodiments, includes greater than about 50 weight percent of the N,N-bis(2-hydroxylethyl)aminomethylphosphonic acid diethyl ester, greater than about 20 weight percent of the cyclized product of N,N-bis(2-hydroxylethyl)aminomethylphosphonic acid diethyl ester, and less than about 20 weight percent of the diethyl (hydroxymethyl)phosphonate intermediate. In further approaches, the second phosphorus compound may include about 50 to about 60 weight percent of N,N-bis(2-hydroxylethyl) aminomethylphosphonic acid diethyl ester, about 20 to about 30 weight percent of the cyclized N,N-bis(2-hydroxylethyl)aminomethylphosphonic acid diethyl ester, and less than about 20 wt % diethyl (hydroxymethyl) phosphonate intermediate.

Third Phosphorus Compound

The third phosphorus compound of the lubricating compositions and methods herein is a hydrocarbyl phosphonate monoester. In approaches, the third phosphorus compound includes about 7 to about 10 weight percent phosphorus and provides about 5 ppm to about 40 ppm of phosphorus to the lubricating composition (in other approaches, about 8 ppm to about 30 ppm of phosphorus, in further approaches, about 10 to about 25 ppm, or in yet other approaches, about 12 ppm to about 20 ppm of phosphorus). In alternative approaches, the lubricating compositions herein include about 0.01 weight percent to about 0.04 weight percent of the third phosphorus compound (in other approaches, about 0.011 weight percent to about 0.03 weight percent, in further approaches, about 0.012 weight percent to about 0.02 weight percent, or in yet other approaches, about 0.014 weight percent to about 0.02 weight percent of the third phosphorus compound).

In other approaches or embodiments, the third phosphorus compound provides phosphorus to the lubricating composition in an amount ranging from at least about 5 ppm, at least about 10 ppm, at least about 12 ppm, or at least about 15 ppm to about 40 ppm or less, about 35 ppm or less, about 25 ppm or less, or about 20 ppm or less (or any ranges between such endpoints). In yet other approaches, the treat rate of the third phosphorus compound in the lubricating composition may range from at least about 0.01 weight percent, at least about 0.011 weight percent, at least about 0.012 weight percent, at least about 0.014 weight percent, or at least about 0.015 weight percent to about 0.04 weight percent or less, about 0.035 weight percent or less, about 0.03 weight percent or less, about 0.025 weight percent or less, or about 0.02 weight percent or less (or any ranges between such endpoints).

In some approaches, the hydrocarbyl phosphonate monoesters include one or more compounds having the structure of Formula III (Formula III)

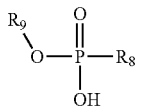

wherein $R_8$, the hydrocarbyl moiety, is a linear or branched C12 to C30 hydrocarbyl chain (in other approaches, a C12 to C24 hydrocarbyl chain or a C12 to C20 hydrocarbyl chain) and $R_9$, the monoester moiety, is a linear or branched C1 to C4 alkyl group and, preferably a methyl group, an ethyl group, a propyl group, or an isopropyl group.

Exemplary phosphonate compounds include methyl hydrocarbyl phosphonates, ethyl hydrocarbyl phosphonates, propyl hydrocarbyl phosphonates, butyl hydrocarbyl phosphonates, iso-butyl hydrocarbyl phosphonates, and wherein, in each case, the hydrocarbyl group is preferably linear, saturated, or contains one or more olefinic double bonds with each double bond preferably being an internal double bond. Other suitable compounds include those in which the hydrocarbyl group bonded to the phosphorus atom contains 16 to 20 carbon atoms or 18 to 20 carbon atoms. A particularly suitable phosphonate monoester compound may be ethyl octadecyl phosphonate or methyl octadecyl phosphonate. Other examples of suitable phosphonate monoesters include, but are not limited to, methyl triacontyl phosphonate, methyl triacontenyl phosphonate, methyl eicosyl phosphonate, methyl hexadecyl phosphonate, methyl hexadecenyl phosphonate, methyl tetracontenyl phosphonate, methyl hexacontyl phosphonate, methyl dodecyl phosphonate, methyl dodecenyl phosphonate, ethyl triacontyl phosphonate, ethyl triacontenyl phosphonate, ethyl eicosyl phosphonate, ethyl hexadecyl phosphonate, ethyl hexadecenyl phosphonate, ethyl tetracontenyl phosphonate, ethyl hexacontyl phosphonate, ethyl dodecyl phosphonate, ethyl dodecenyl phosphonate, and the like compounds, and mixtures thereof. Preferably, the third phosphorus compound is methyl octadecyl phosphonate.

Nitrogen-Containing Polyisobutylene Succinimide

The nitrogen-containing polyisobutylene succinimide of the lubricating compositions and methods herein include one or more succinimide compounds derived from polyisobutylene having an number average molecular weight of at least about 500 and, in other approaches, about 500 to about 2,500 g/mol as determined by gel permeation chromatograph using polystyrene as a standard. The nitrogen-containing polyisobutylene succinimides herein include about 1.6 to about 2.1 weight percent nitrogen and provide about 20 to about 105 ppm of nitrogen to the lubricating compositions (in other approaches, about 30 ppm to about 90 ppm of nitrogen, in further approaches, about 40 to about 80 ppm, or in yet other approaches, about 50 ppm to about 75 ppm of nitrogen). In alternative approaches, the lubricating compositions herein include about 0.2 weight percent to about 0.5 weight percent of the nitrogen-containing polyisobutylene succinimide (in other approaches, about 0.25 weight percent to about 0.45 weight percent, in further approaches, about 0.3 weight percent to about 0.4 weight percent, or in yet other approaches, about 0.32 weight percent to about 0.38 weight percent of the nitrogen-containing polyisobutylene succinimide).

In other approaches or embodiments, the nitrogen-containing polyisobutylene succinimide provides nitrogen to the lubricating composition in an amount ranging from at least about 30 ppm, at least about 40 ppm, at least about 50 ppm to about 105 ppm or less, about 100 ppm or less, about 90 ppm or less, about 80 ppm or less, or 70 ppm or less (or any ranges between such endpoints). In yet other approaches, the treat rate of the nitrogen-containing polyisobutylene succinimide in the lubricating composition may range from at least about 0.2 weight percent, at least about 0.25 weight percent, at least about 0.3 weight percent, at least about 0.35 weight percent to about 0.5 weight percent or less, about 0.45 weight percent or less, about 0.4 weight percent or less, or about 0.38 weight percent or less (or any ranges between such endpoints).

In one approach, the nitrogen-containing polyisobutylene succinimide is a nitrogen-substituted long chain alkenyl succinimide that includes one or more compounds having a structure of Formula IV:

(Formula IV)

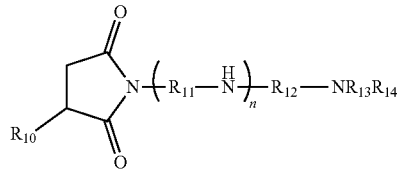

wherein $R_{10}$ is a polyisobutylene having a number average molecular weight of about 500 to about 2,500 g/mol using gel permeation chromatography and polystyrene as the standard (in other approaches, about 500 to about 2,200 g/mol, or about 800 to about 2,000 g/mol, or about 800 to about 1,500 g/mol, or about 800 to about 1000 g/mol, or any other ranges between such noted endpoints); $R_{11}$ and $R_{12}$ are, independently, a divalent $C_1$-$C_6$ alkylene; each of $R_{13}$ and $R_{14}$, independently, is hydrogen, $C_1$-$C_6$ alkyl, or together with the N to which they are attached form a 5- or 6-membered ring optionally fused with one or more aromatic or non-aromatic rings; and n is an integer from 0 to 8.

In other approaches, $R_{13}$ and $R_{14}$ of Formula IV, together with the N to which they are attached, form a succinimide moiety of Formula V forming a bis-succinimide compound for the nitrogen-containing polyisobutylene succinimide herein:

(Formula V)

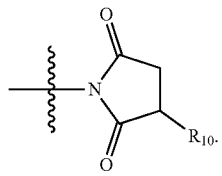

In yet other approaches, each of $R_{11}$ and $R_{12}$ of the compounds of Formula IV and Formula V are C2 alkylene and n is an integer of 2.

Such succinimide compounds and their preparation are known and disclosed, for instance, in U.S. Pat. No. 7,897,696 or U.S. Pat. No. 4,234,435, which are incorporated herein by reference. The alkenyl or hydrocarbyl substituent of the succinimide may be prepared from polymerizable monomers containing about 2 to about 16, or about 2 to about 8, or about 2 to about 6 carbon atoms. Succinimide compounds are typically the imide formed from a polyamine, typically a poly(ethyleneamine).

In approaches, preferred amines for the nitrogen-containing succinimide herein may be selected from polyamines and hydroxylamines. Examples of polyamines that may be used include, but are not limited to, diethylene triamine (DETA), triethylene tetramine (TETA), tetraethylene pentamine (TEPA), and higher homologues such as pentaethylamine hexamine (PEHA), and the like. In some approaches, a so-called polyamine bottoms product and/or a heavy polyamine may be used, which is a mixture of polyalkylene-polyamines comprising small amounts of lower polyamine oligomers such as TEPA and PEHA (pentaethylene hexamine) but primarily oligomers with 6 or more nitrogen atoms, 2 or more primary amines per molecule, and more extensive branching than conventional polyamine mixtures. In one approach, a polyamine bottoms product and/or a heavy polyamine preferably includes polyamine oligomers containing 7 or more nitrogen atoms per molecule and with 2 or more primary amines per molecule.

In some embodiments, polyisobutylene (PIB), when included in the nitrogen-containing polyisobutylene succinimide s herein, is a preferred reactant and may have greater than 50 mol %, greater than 60 mol %, greater than 70 mol %, greater than 80 mol %, or greater than 90 mol % content of terminal double bonds. Such PIB is also referred to as highly reactive PIB ("HR—PIB"). HR—PIB having a number average molecular weight ranging from about 800 to about 5000, as determined by GPC, is suitable for use in embodiments of the present disclosure. Conventional PIB typically has less than 50 mol %, less than 40 mol %, less than 30 mol %, less than 20 mol %, or less than 10 mol % content of terminal double bonds.

An HR—PIB having a number average molecular weight ranging from about 500 to about 2,500 g/mol may be suitable, as determined by GPC using polystyrene as a standard or, preferably about 500 to about 1,500 or about 800 to about 1000. Such HR—PIB is commercially available, or can be synthesized by the polymerization of isobutene in the presence of a non-chlorinated catalyst such as boron trifluoride, as described in U.S. Pat. No. 4,152,499 and/or U.S. Pat. No. 5,739,355. When used in the aforementioned thermal ene reaction, HR—PIB may lead to higher conversion rates in the reaction, as well as lower amounts of sediment formation, due to increased reactivity. A suitable method is described in U.S. Pat. No. 7,897,696. In one embodiment, the present disclosure further comprises at least one nitrogen-containing polyisobutylene succinimide derived from polyisobutylene succinic anhydride ("PIBSA"). The PIBSA may have an average of between about 1.0 and about 2.0 succinic acid moieties per polymer.

In some approaches, some of the nitrogen-containing polyisobutylene succinimides in the lubricating compositions and methods herein may be free of any post-treatments, such as post treatments with boron, urea, thiourea, dimercapto thiadiazoles, carbon disulfide, aldehydes, ketones, carboxylic acids, hydrocarbon-substituted succinic anhydrides, maleic anhydride, nitriles, epoxides, carbonates, cyclic carbonates, hindered phenolic esters, and phosphorus compound. In other embodiments, the nitrogen-containing polyisobutylene succinimide s in the lubricating compositions herein may be post-treated by conventional methods by a reaction with any of a variety of post-treat agents. If post-treated, suitable post treat agents include boron, urea, thiourea, dimercapto thiadiazoles, carbon disulfide, aldehydes, ketones, carboxylic acids, hydrocarbon-substituted succinic anhydrides, maleic anhydride, nitriles, epoxides, carbonates, cyclic carbonates, hindered phenolic esters, and phosphorus compounds. (See, e.g., U.S. Pat. Nos. 7,645,726; 7,214,649; 8,048,831; and 5,241,003, which are all incorporated herein by reference in their entireties.)

If post treated with boron, the boron compound used as a post-treating reagent can be selected from boron oxide, boron halides, boron acids and esters of boron acids in an amount to provide from about 0.1 atomic proportion of boron for each mole of the nitrogen composition to about 20 atomic proportions of boron for each atomic proportion of nitrogen used. If treated, any nitrogen-containing polyisobutylene succinimide post-treated with boron may contain from about 0.05 weight percent to about 2.0 weight percent, or in other approaches, about 0.05 weight percent to about 0.7 weight percent boron, based on the total weight of the borated nitrogen-containing polyisobutylene succinimide.

In other approaches and if used, the carboxylic acid may also be used as a post-treating reagent and can be saturated or unsaturated mono-, di-, or poly-carboxylic acid. Examples of carboxylic acids include, but are not limited to, maleic acid, fumaric acid, succinic acid, and naphthalic diacid (e.g., 1,8-naphthalic diacid). Anhydrides can also be used as a post-treating reagent and can be selected from the group consisting of mono-unsaturated anhydride (e.g., maleic anhydride), alkyl or alkylene-substituted cyclic anhydrides (e.g., succinic anhydride or glutamic anhydride), and aromatic carboxylic anhydrides (including naphthalic anhydride, e.g., 1,8-naphthalic anhydride).

In one embodiment and if used, the process of post-treating the nitrogen-containing polyisobutylene succinimide s herein includes first forming the succinimide product, as described above, and then further reacting the succinimide product with the post treating agent, such as a boron compound, such as boric acid. In some cases, the nitrogen-containing polyisobutylene succinimide s herein may be post-treated with more than one post-treatment agents. For example, the nitrogen-containing polyisobutylene succinimide may be post-treated with a boron compound, such as boric acid, and also an anhydride, such as maleic anhydride and/or 1,8-naphthalic anhydride.

Base Oil

In one approach, suitable base oils for use in the lubricating composition or gear fluids herein include mineral oils, synthetic oils, re-refined oils, and include all common mineral oil basestocks. The mineral oil may be naphthenic or paraffinic. The mineral oil may be refined by conventional methodology using acid, alkali, and clay or other agents such as aluminium chloride, or may be an extracted oil produced, e.g. by solvent extraction with solvents such as phenol, sulfur dioxide, furfural or dichlorodiethyl ether. The mineral oil may be hydrotreated or hydrofined, dewaxed by chilling or catalytic dewaxing processes, or hydrocracked, such as the Yubase® family of hydrockracked base oils from SK Innovation Co., Ltd. (Seoul, Korea). The mineral oil may be produced from natural crude sources or be composed of isomerized wax materials or residues of other refining processes.

The base oil or base oil of lubricating viscosity used in the compositions herein may be selected from any suitable base oil for driveline or gear oil applications. Examples include the base oils in Groups I-V as specified in the American Petroleum Institute (API) Base Oil Interchangeability Guidelines. These three base oil groups are as follows:

TABLE 1

| Base oil Types | | | | |
|---|---|---|---|---|
| Base oil Category | Sulfur (%) | | Saturates (%) | Viscosity Index |
| Group I | >0.03 | and/or | <90 | 80 to 120 |
| Group II | ≤0.03 | and | ≥90 | 80 to 120 |
| Group III | ≤0.03 | and | ≥90 | ≥120 |
| Group IV | All polyalphaolefins (PAOs) | | | |
| Group V | All others not included in Groups I, II, III, or IV | | | |

Groups I, II, and III are mineral oil process stocks and may be preferred for the driveline or gear fluids of the present application. It should be noted that although Group III base oils are derived from mineral oil, the rigorous processing that these fluids undergo causes their physical properties to be very similar to some true synthetics, such as PAOs. Therefore, oils derived from Group III base oils may be referred to as synthetic fluids in the industry. Suitable oils may be derived from hydrocracking, hydrogenation, hydrofinishing, unrefined, refined, and re-refined oils, and mixtures thereof. In some approaches, the base oil may be a blend of Group I and Group II oils and the blend may be about 0% to about 100% of the Group I oil, about 0% to about 100% of the Group II oil, about 0% to about 100% of the Group III oil, or various blends of Group I and II, Group I and III, or Group II and III oil blends.

Unrefined oils are those derived from a natural, mineral, or synthetic source without or with little further purification treatment. Refined oils are similar to the unrefined oils except that they have been treated in one or more purification steps, which may result in the improvement of one or more properties. Examples of suitable purification techniques are solvent extraction, secondary distillation, acid or base extraction, filtration, percolation, and the like. Oils refined to the quality of an edible may or may not be useful. Edible oils may also be called white oils. In some embodiments, lubricating oil compositions are free of edible or white oils.

Re-refined oils are also known as reclaimed or reprocessed oils. These oils are obtained similarly to refined oils using the same or similar processes. Often these oils are additionally processed by techniques directed to removal of spent additives and oil breakdown products.

Mineral oils may include oils obtained by drilling or from plants and animals or any mixtures thereof. For example such oils may include, but are not limited to, castor oil, lard oil, olive oil, peanut oil, corn oil, soybean oil, and linseed oil, as well as mineral lubricating oils, such as liquid petroleum oils and solvent-treated or acid-treated mineral lubricating oils of the paraffinic, naphthenic or mixed paraffinic-naphthenic types. Such oils may be partially or fully hydrogenated, if desired. Oils derived from coal or shale may also be useful.

The major amount of base oil included in the gear fluids herein may be selected from the group consisting of Group I, Group II, a Group III, and a combination of two or more of the foregoing, and wherein the major amount of base oil is other than base oils that arise from provision of additive components or viscosity index improvers in the composition. In another embodiment, the major amount of base oil included in a lubricating composition may be selected from the group consisting of Group I, a Group II, and a combination of two or more of the foregoing, and wherein the major amount of base oil is other than base oils that arise from provision of additive components or viscosity index improvers in the composition.

The base oil may also be any of the synthetic base oils. Useful synthetic lubricating oils may include hydrocarbon oils such as polymerized, oligomerized, or interpolymerized olefins (e.g., polybutylenes, polypropylenes, propyleneisobutylene copolymers); poly(1-hexenes), poly(1-octenes), trimers or oligomers of 1-decene, e.g., poly(1-decenes), such materials being often referred to as α-olefins, and mixtures thereof; alkyl-benzenes (e.g. dodecylbenzenes, tetradecylbenzenes, dinonylbenzenes, di-(2-ethylhexyl)-benzenes); polyphenyls (e.g., biphenyls, terphenyls, alkylated polyphenyls); diphenyl alkanes, alkylated diphenyl alkanes, alkylated diphenyl ethers and alkylated diphenyl sulfides and the derivatives, analogs and homologs thereof or mixtures thereof. Polyalphaolefins are typically hydrogenated materials.

Other synthetic lubricating oils include polyol esters, diesters, liquid esters of phosphorus-containing acids (e.g., tricresyl phosphate, trioctyl phosphate, and the diethyl ester of decane phosphonic acid), or polymeric tetrahydrofurans. Synthetic oils may be produced by Fischer-Tropsch reactions and typically may be hydroisomerized Fischer-Tropsch hydrocarbons or waxes. In one embodiment oils may be prepared by a Fischer-Tropsch gas-to-liquid synthetic procedure as well as other gas-to-liquid oils.

The amount of the base oil of lubricating viscosity in the compositions herein may be the balance remaining after subtracting from 100 wt % the sum of the amount of the performance additives. For example, the oil of lubricating viscosity that may be present in a finished fluid may be a "major amount," such as greater than about 50 wt %, greater than about 60 wt %, greater than about 70 wt %, greater than about 80 wt %, greater than about 85 wt %, greater than about 90 wt %, or greater than 95 wt %.

A suitable transmission or gear lubricant composition herein may include additive components in the ranges listed in the following Table 2.

TABLE 2

| Suitable and Preferred Transmission or Gear Fluid Compositions | | |
|---|---|---|
| Component | Wt % (Suitable Embodiments) | Wt % (Preferred Embodiments) |
| First Phosphorus Compound | 0.01-0.075 | 0.02-0.05 |
| Second Phosphorus Compound | 0.01-0.05 | 0.02-0.04 |
| Third Phosphorus Compound | 0.01-0.04 | 0.01-0.03 |
| Nitrogen-containing polyisobutylene succinimide | 0.2-0.5 | 0.3-0.4 |
| Antioxidant(s) | 0.1-5.0 | 0.01-4.0 |
| Corrosion inhibitor(s) | 0.0-5.0 | 0.1-3.0 |
| Ash-free phosphorus compound(s) | 0.0-15.0 | 0.1-5.0 |
| Antifoaming agent(s) | 0.0-1.0 | 0.001-0.5 |
| Antiwear agent(s) | 0.0-1.0 | 0.0- 0.8 |
| Pour point depressant(s) | 0.0-1.0 | 0.01-0.5 |
| Viscosity index improver(s) | 0.0-20.0 | 0.1-10.0 |
| Dispersants | 0.0-10.0 | 0.05-6.0 |
| Dispersant viscosity index improver(s) | 0.0-10.0 | 0.0-5.0 |
| Friction modifier(s) | 0.0-10.0 | 0.01-4.0 |
| Extreme Pressure Agent | 0.0-1.5 | 0.8-1.3 |
| Base oil(s) | Balance | Balance |
| Total | 100 | 100 |

The percentages of each component above represent the weight percent of each component, based upon the weight of the total final additive or lubricating oil composition. The balance of the lubricating oil composition consists of one or more base oils or solvents. Additives used in formulating the compositions described herein may be blended into the base oil or solvent individually or in various sub-combinations. However, it may be suitable to blend all of the components concurrently using an additive concentrate (i.e., additives plus a diluent, such as a hydrocarbon solvent).

In approaches or embodiments, the lubricating compositions herein include about 30 ppm to about 200 ppm of total phosphorus from all three phosphorus compounds (in other approaches, a total of about 40 ppm to about 150 ppm total phosphorus, or about 50 to about 100 ppm of total phosphorus, or about 50 ppm to about 80 ppm of total phosphorus). In further approaches, the lubricating compositions herein includes about 7 ppm to about 75 ppm of phosphorus provided by the first phosphorus compound, about 10 ppm to about 65 ppm of phosphorus provided by the second phosphorus compound, and about 5 ppm to about 40 ppm of phosphorus provided by third phosphorus compound. In alternative approaches, about 30 to about 45 weight percent of the total phosphorus is provided by the first phosphorus compound, about 35 to about 40 weight percent of the total phosphorus is provided by the second phosphorus compound, and about 20 to about 30 weight percent of the total phosphorus is provided by the third phosphorus compound. In yet other optional approaches, the lubricating compositions herein include greater than 50 weight percent of the phosphorus provided by the second and third phosphorus compounds combined with the remaining phosphorus contributed by the first phosphorus compound. However, as shown by the Examples below, the presence of the three phosphorus compound is not sufficient to achieve passing wear, extreme pressure, friction, and copper corrosion. Only when further including the specific nitrogen-containing polyisobutylene succinimides disclosed herein does the lubricating compositions achieve passing performance in all four performance tests. To this end, the lubricating compositions herein, in some embodiments, also include about 30 to about 105 ppm of nitrogen from the embodiments of the nitrogen-containing polyisobutylene succinimide and, in other embodiments, also have a weight ratio of phosphorus from the three phosphorus compounds to nitrogen from the nitrogen-containing polyisobutylene succinimide of about 1:1 to about 2.2:1.

In any embodiment or approach herein, such combinations of three phosphorus compounds and the nitrogen-containing polyisobutylene succinimide provides lubricating compositions that achieves a mean wear scar of about 0.5 mm or less (preferably, about 0.48 mm or less, more preferably, about 0.45 mm or less, or about 0.42 mm or less) pursuant to ASTM D4172 (40 kgf, 75° C., 1800 rpm, 60 minutes) and, at the same time, also a Load Wear Index (LWI) of 46 or higher (preferably, 48 or higher, and more preferably 50 or higher) pursuant to ASTM D2783 and, at the same time, a friction coefficient of about 0.125 or higher (preferably, about 0.128 or higher) when tested on a high frequency reciprocating rig (HFRR) as further discussed herein (when tested at a 400 g load, 20 Hz, 80° C. for 3 minutes) and, at the same time, a copper corrosion rating of 2b or better (e.g., 2b, 2a, 1b, or 1a) when tested pursuant to ASTM D130 for 3 hours at 100° C. The lubricating compositions herein achieve such performance even with a low viscosity having a KV100 of about 5 to about 60 cSt (preferably about 5 to about 66, about 8 to about 55 cSt, about 8 to about 40 cSt, about 8 to about 30 cSt, about 8 to about 20 cSt, or about 8 to about 15 cSt) as measured at 100° C. using ASTM D445.

As used herein, the friction coefficient was measured at 80° C. using a High Frequency Reciprocating Rig (HFRR), such as one from PCS instruments or the like, using test conditions as generally described in SAE paper 982503 (except the measurement temperature as noted above). This test determines the samples' friction coefficients using an SAE 52100 metal ball and an SAE 52100 metal disk. The ball was oscillated across the disk at a frequency of 20 Hz over a 1 mm path, with an applied load of 400 grams. Each sample was tested in the HFRR for 3 minutes and the data over the last 2 minutes was averaged to produce the friction coefficients. As shown in the Examples, a higher friction coefficient is preferred for the lubricants herein, and preferably a friction coefficient of about 0.128 or greater (and preferably, about 0.128 to about 0.148 or about 0.128 to about 0.135).

The lubricating compositions herein may be used for lubricating a machine part, such as a gear, transmission, or gear box component. Lubricating fluids according to the present disclosure can be used in gear applications, such as industrial gear applications, automotive gear applications, axles, and stationary gearboxes. Gear-types can include, but are not limited to, spur, spiral, worm, rack and pinion, involute, bevel, helical, planetary, and hypoid gears and as well as limited-slip applications and differentials. The lubricating compositions disclosed herein are also suitable for automatic or manual transmissions, including step automatic transmissions, continuously variable transmissions, semi-automatic transmissions, automated manual transmissions, toroidal transmissions, and dual clutch transmissions.

Optional Additives

In other approaches, the lubricant including such additives noted above may also include one or more optional components so long as such components and amounts thereof do not impact the performance characteristics as described in the above paragraphs. These optional components are described in the following paragraphs.

Other Phosphorus-Containing Compounds

The lubricant compositions herein may comprise one or more other phosphorus-containing compounds that may impart anti-wear benefits to the fluid so long as the noted phosphorus compounds and amounts above are satisfied. The one or more other phosphorus-containing compounds may be present in the lubricating oil composition in an amount ranging from about 0 wt % to about 15 wt %, or about 0.01 wt % to about 10 wt %, or about 0.05 wt % to about 5 wt %, or about 0.1 wt % to about 3 wt % of the lubricating oil composition. The optional other phosphorus-containing compound may provide up to 5000 ppm phosphorus, or from about 50 ppm to about 5000 ppm phosphorus, or from about 300 ppm to about 1500 ppm phosphorus, or up to 600 ppm phosphorus, or up to 900 ppm phosphorus to the lubricant composition.

The one or more other phosphorus-containing compounds may include ashless phosphorus-containing compounds. Examples of suitable phosphorus-containing compound include, but are not limited to, thiophosphates, dithiophosphates, phosphates, phosphoric acid esters, phosphate esters, phosphites, phosphonates, phosphorus-containing carboxylic esters, ethers, or amides salts thereof, and mixtures thereof. Phosphorus containing anti-wear agents are more fully described in European Patent 0612839.

It should be noted that often the term phosphonate and phosphite are used often interchangeably in the lubricant industry. For example, dibutyl hydrogen phosphonate is often referred to as dibutyl hydrogen phosphite. It is within the scope of the present invention for the inventive lubricant composition to include a phosphorus-containing compound that may be referred to as either a phosphite or a phosphonate.

In any of the above described phosphorus-containing compounds, the compound may have about 5 weight percent to about 20 weight percent phosphorus, or about 5 weight percent to about 15 weight percent phosphorus, or about 8 weight percent to about 16 weight percent phosphorus, or about 6 weight percent to about 9 weight percent phosphorus.

Another type of phosphorus-containing compound that is an ashless (metal free) phosphorus-containing compound. In some embodiments, the ashless phosphorus-containing compound may be dialkyl dithiophosphate ester, amyl acid phosphate, diamyl acid phosphate, dibutyl hydrogen phosphonate, dimethyl octadecyl phosphonate, salts thereof, and mixtures thereof. The ashless phosphorus-containing compound may be have the formula:

(Formula XIV)

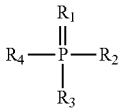

wherein R1 is S or O; R2 is —OR", —OH, or —R"; R3 is —OR", —OH, or SR'"C(O)OH; R4 is —OR"; R'" is C1 to C3 branched or linear alkyl chain; and R" is a C1 to C18 hydrocarbyl chain. When the phosphorous-containing compound has the structure shown in Formula XIV, the compound may have about 8 to about 16 weight percent phosphorus.

In some embodiments the lubricant composition comprises a phosphorus-containing compound of Formula XIV wherein R1 is S; R2 is —OR"; R3 is S R'"COOH; R4 is —OR"; R'" is C3 branched alkyl chain; R" is C4; and wherein the phosphorus-containing compound is present in an amount to deliver between 80-900 ppm phosphorus to the lubricant composition.

In another embodiment, the lubricant composition comprises a phosphorus-containing compound of Formula XIV wherein R1 is O; R2 is —OH; R3 is —OR" or —OH; R4 is —OR"; R" is C5; and wherein phosphorus-containing compound is present in an amount to deliver between 80-1500 ppm phosphorus to the lubricant composition.

In yet another embodiment, the lubricant composition comprises a phosphorus-containing compound of Formula XIV wherein R1 is O; R2 is OR"; R3 is H; R4 is —OR"; R" is C4; and wherein the one or more phosphorus-containing compound(s) is present in an amount to deliver between 80-1550 ppm phosphorus to the lubricant composition.

In other embodiments, the lubricant composition comprises a phosphorus-containing compound of Formula XIV wherein R1 is O; R2 is —R"; R3 is —OCH3 or —OH; R4 is —OCH3; R" is C18; and wherein the one or more phosphorus-containing compound(s) is present in an amount to deliver between 80-850 ppm phosphorus to the lubricant composition.

In some embodiments, the phosphorus-containing compound has the structure shown in Formula XIV and delivers about 80 ppm to about 4500 ppm phosphorus to the lubricant composition. In other embodiments, the phosphorus-containing compound is present in an amount to deliver between about 150 ppm and about 1500 ppm phosphorus, or between about 300 ppm and about 900 ppm phosphorus, or between about 800 ppm to 1600 ppm phosphorus, or about 900 ppm to about 1800 ppm phosphorus, to the lubricant composition.

Other Anti-Wear Agents

The lubricant composition may also include other antiwear agents that are non-phosphorus-containing compounds. Examples of such antiwear agents include borate esters, borate epoxides, thiocarbamate compounds (including thiocarbamate esters, alkylene-coupled thiocarbamates, and bis(S-alkyldithiocarbamyl)disulfides, thiocarbamate amides, thiocarbamic ethers, alkylene-coupled thiocarbamates, and bis(S-alkyldithiocarbamyl) disulfides, and mixtures thereof), sulfurized olefins, tridecyl adipate, titanium compounds, and long chain derivatives of hydroxyl carboxylic acids, such as tartrate derivatives, tartramides, tartrimides, citrates, and mixtures thereof. A suitable thiocarbamate compound is molybdenum dithiocarbamate. Suitable tartrate derivatives or tartrimides may contain alkyl-ester groups, where the sum of carbon atoms on the alkyl groups may be at least 8. The tartrate derivative or tartrimide may contain alkyl-ester groups, where the sum of carbon atoms on the alkyl groups may be at least 8. The antiwear agent may in one embodiment include a citrate. The additional anti-wear agent may be present in ranges including about 0 wt % to about 15 wt %, or about 0.01 wt % to about 10 wt %, or about 0.05 wt % to about 5 wt %, or about 0.1 wt % to about 3 wt % of the lubricating oil composition.

Other Extreme Pressure Agents

The lubricant compositions of the disclosure may also contain other extreme pressure agent(s). The extreme pressure agent may contain sulfur and may contain at least 12 percent by weight sulfur. In some embodiments, the extreme pressure agent added to the lubricating oil is sufficient to provide at least 350 ppm sulfur, 500 ppm sulfur, 760 ppm sulfur, from about 350 ppm to about 2,000 ppm sulfur, from about 2,000 ppm to about 30,000 ppm sulfur, or from about 2,000 ppm to about 4,800 ppm sulfur, or about 4,000 ppm to about 25,000 ppm sulfur to the lubricant composition.

A wide variety of sulfur-containing extreme pressure agents are suitable and include sulfurized animal or vegetable fats or oils, sulfurized animal or vegetable fatty acid esters, fully or partially esterified esters of trivalent or pentavalent acids of phosphorus, sulfurized olefins (see, for example U.S. Pat. Nos. 2,995,569; 3,673,090; 3,703,504; 3,703,505; 3,796,661; 3,873,454 4,119,549; 4,119,550; 4,147,640; 4,191,659; 4,240,958; 4,344,854; 4,472,306; and 4,711,736), dihydrocarbyl polysulfides (see for example U.S. Pat. Nos. 2,237,625; 2,237,627; 2,527,948; 2,695,316; 3,022,351; 3,308,166; 3,392,201; 4,564,709; and British 1,162,334), functionally-substituted dihydrocarbyl polysulfides (see for example U.S. Pat. No. 4,218,332), and polysulfide olefin products (see for example U.S. Pat. No. 4,795,576). Other suitable examples include organo-sulfur compounds selected from sulfurized olefins, sulfur-containing amino heterocyclic compounds, 5-dimercapto-1,3,4-thiadiazole, polysulfides having a majority of S3 and S4 sulfides, sulfurized fatty acids, sulfurized branched olefins, organic polysulfides, and mixtures thereof.

In some embodiments the extreme pressure agent is present in the lubricating composition in an amount of up to about 3.0 wt % or up to about 5.0 wt %. In other embodiments, the extreme pressure agent is present from about 0.05 wt % to about 1.5 wt %, based on the total lubricant composition. In other embodiments, the extreme pressure agent is present from about 0.1 wt % to about 3.0 wt %, based on the total lubricant composition. In other embodiments the extreme pressure agent is present in an amount between about 0.6 wt % and about 1.3 wt %, based on the total lubricant composition.

One suitable class of extreme pressure agents are polysulfides composed of one or more compounds represented by the formula: Ra-Sx-Rb where Ra and Rb are hydrocarbyl groups each of which may contain 1 to 18, and in other approaches, 3 to 18 carbon atoms and x is may be in the range of from 2 to 8, and typically in the range of from 2 to 5, especially 3. In some approaches, x is an integer from 3 to 5 with about 30 to about 60 percent of x being an integer of 3 or 4. The hydrocarbyl groups can be of widely varying types such as alkyl, cycloalkyl, alkenyl, aryl, or aralkyl. Tertiary alkyl polysulfides such as di-tert-butyl trisulfide, and mixtures comprising di-tert-butyl trisulfide (e.g., a mixture composed principally or entirely of the tri, tetra-, and pentasulfides) may be used. Examples of other useful dihydrocarbyl polysulfides include the diamyl polysulfides, the dinonyl polysulfides, the didodecyl polysulfides, and the dibenzyl polysulfides.

Another suitable class of extreme pressure agent is sulfurized isobutenes made by reacting an olefin, such as isobutene, with sulfur. Sulfurized isobutene (SIB), notably sulfurized polyisobutylene, typically has a sulfur content of from about 10 to about 55%, desirably from about 30 to about 50% by weight. A wide variety of other olefins or unsaturated hydrocarbons, e.g., isobutene dimer or trimer, may be used to form the sulfurized olefin extreme pressure agents. Various methods have been disclosed in the prior art for the preparation of sulfurized olefins. See, for example, U.S. Pat. No. 3,471,404 to Myers; U.S. Pat. No. 4,204,969 to Papay et al.; U.S. Pat. No. 4,954,274 to Zaweski et al.; U.S. Pat. No. 4,966,720 to DeGonia et al.; and U.S. Pat. No. 3,703,504 to Horodysky, et al, each of which his incorporated herein by reference.

Methods for preparing sulfurized olefins, including the methods disclosed in the aforementioned patents, generally involve formation of a material, typically referred to as an "adduct", in which an olefin is reacted with a sulfur halide, for example, sulfur monochloride. The adduct is then reacted with a sulfur source to provide the sulfurized olefin. The quality of a sulfurized olefin is generally measured by various physical properties, including, for example, viscosity, sulfur content, halogen content and copper corrosion test weight loss. U.S. Pat. No. 4,966,720, relates to sulfurized olefins useful as extreme pressure additives in lubrication oils and to a two stage reaction for their preparation.

Antioxidants

The lubricating oil compositions herein also may optionally contain one or more antioxidants. Antioxidant compounds are known and include for example, phenates, phenate sulfides, sulfurized olefins, phosphosulfurized terpenes, sulfurized esters, aromatic amines, alkylated diphenylamines (e.g., nonyl diphenylamine, di-nonyl diphenylamine, octyl diphenylamine, di-octyl diphenylamine), phenyl-alpha-naphthylamines, alkylated phenyl-alpha-naphthylamines, hindered non-aromatic amines, phenols, hindered phenols, oil-soluble molybdenum compounds, macromolecular antioxidants, or mixtures thereof. Antioxidant compounds may be used alone or in combination.

The hindered phenol antioxidant may contain a secondary butyl and/or a tertiary butyl group as a sterically hindering group. The phenol group may be further substituted with a hydrocarbyl group and/or a bridging group linking to a second aromatic group. Examples of suitable hindered phenol antioxidants include 2,6-di-tert-butylphenol, 4-methyl-2,6-di-tert-butylphenol, 4-ethyl-2,6-di-tert-butylphenol, 4-propyl-2,6-di-tert-butylphenol or 4-butyl-2,6-di-tert-butylphenol, or 4-dodecyl-2,6-di-tert-butylphenol. In one embodiment the hindered phenol antioxidant may be an ester and may include, e.g., Irganox® L-135 available from BASF or an addition product derived from 2,6-di-tert-butylphenol and an alkyl acrylate, wherein the alkyl group may contain about 1 to about 18, or about 2 to about 12, or about 2 to about 8, or about 2 to about 6, or about 4 carbon atoms. Another commercially available hindered phenol antioxidant may be an ester and may include Ethanox® 4716 available from Albemarle Corporation.

Useful antioxidants may include diarylamines and phenols. In an embodiment, the lubricating oil composition may contain a mixture of a diarylamine and a phenol, such that each antioxidant may be present in an amount sufficient to provide up to about 5 wt %, based on the weight of the lubricant composition. In an embodiment, the antioxidant may be a mixture of about 0.3 to about 1.5 wt % diarylamine and about 0.4 to about 2.5 wt % phenol, based on the lubricant composition.

Examples of suitable olefins that may be sulfurized to form a sulfurized olefin include propylene, butylene, isobutylene, polyisobutylene, pentene, hexene, heptene, octene, nonene, decene, undecene, dodecene, tridecene, tetradecene, pentadecene, hexadecene, heptadecene, octadecene, nonadecene, eicosene or mixtures thereof. In one embodiment, hexadecene, heptadecene, octadecene, nonadecene, eicosene or mixtures thereof and their dimers, trimers and tetramers are especially useful olefins. Alternatively, the olefin may be a Diels-Alder adduct of a diene such as 1,3-butadiene and an unsaturated ester, such as, butylacrylate.

Another class of sulfurized olefin includes sulfurized fatty acids and their esters. The fatty acids are often obtained from vegetable oil or animal oil and typically contain about 4 to about 22 carbon atoms. Examples of suitable fatty acids and their esters include triglycerides, oleic acid, linoleic acid, palmitoleic acid or mixtures thereof. Often, the fatty acids are obtained from lard oil, tall oil, peanut oil, soybean oil, cottonseed oil, sunflower seed oil or mixtures thereof. Fatty acids and/or ester may be mixed with olefins, such as α-olefins.

The one or more antioxidant(s) may be present in ranges about 0 wt % to about 20 wt %, or about 0.1 wt % to about 10 wt %, or about 1 wt % to about 5 wt %, of the lubricating oil composition.

Dispersants

Dispersants contained in the lubricant composition may include, but are not limited to, an oil soluble polymeric hydrocarbon backbone having functional groups that are capable of associating with particles to be dispersed. Typically, the dispersants comprise amine, alcohol, amide, or ester polar moieties attached to the polymer backbone often via a bridging group. Dispersants may be selected from Mannich dispersants as described in U.S. Pat. Nos. 3,634,515, 3,697,574 and 3,736,357; ashless succinimide dispersants as described in U.S. Pat. Nos. 4,234,435 and 4,636,322; amine dispersants as described in U.S. Pat. Nos. 3,219,666, 3,565,804, and 5,633,326; Koch dispersants as described in U.S. Pat. Nos. 5,936,041, 5,643,859, and 5,627,259, and polyalkylene succinimide dispersants as described in U.S. Pat. Nos. 5,851,965; 5,853,434; and 5,792,729.

In some embodiments, the additional dispersant may be derived from a polyalphaolefin (PAO) succinic anhydride, an olefin maleic anhydride copolymer. As an example, the additional dispersant may be described as a poly-PIBSA. In another embodiment, the additional dispersant may be derived from an anhydride which is grafted to an ethylene-propylene copolymer. Another additional dispersant may be a high molecular weight ester or half ester amide.

The additional dispersant, if present, can be used in an amount sufficient to provide up to about 10 wt %, based upon the final weight of the lubricating oil composition. Another amount of the dispersant that can be used may be about 0.1 wt % to about 10 wt %, or about 0.1 wt % to about 10 wt %, or about 3 wt % to about 8 wt %, or about 1 wt % to about 6 wt %, based upon the final weight of the lubricating oil composition.

Thickeners

The lubricant compositions herein also may optionally contain one or more thickeners. Suitable additives may include polyolefins, olefin copolymers, ethylene/propylene copolymers, polyisobutenes, hydrogenated styrene-isoprene polymers, styrene/maleic ester copolymers, hydrogenated styrene/butadiene copolymers, hydrogenated isoprene polymers, alpha-olefin maleic anhydride copolymers, polymethacrylates, polyacrylates, polyalkyl styrenes, hydrogenated alkenyl aryl conjugated diene copolymers, or mixtures thereof. Thickeners may include star polymers and suitable examples are described in US Publication No. 20120101017A1, which is incorporated herein by reference.

The total amount of thickeners may be about 0 wt % to about 20 wt %, about 0.1 wt % to about 15 wt %, about 0.1 wt % to about 12 wt %, or about 0.5 wt % to about 10 wt %, about 3 wt % to about 20 wt %, about 3 wt % to about 15 wt %, about 5 wt % to about 15 wt %, or about 5 wt % to about 10 wt %, of the lubricating oil composition.

In some embodiments, the thickener is a polyolefin or olefin copolymer having a number average molecular weight of about 10,000 to about 500,000, about 50,000 to about 200,000, or about 50,000 to about 150,000. In some embodiments, the thickener is a hydrogenated styrene/butadiene copolymer having a number average molecular weight of about 40,000 to about 500,000, about 50,000 to about 200,000, or about 50,000 to about 150,000. In some embodiments, the thickener is a polymethacrylate having a number average molecular weight of about 10,000 to about 500,000, about 50,000 to about 200,000, or about 50,000 to about 150,000.

The terms "gear oil," "gear fluid," "gear lubricant," "base gear lubricant," "lubricating oil," "lubricant composition," "lubricating composition," "lubricant" and "lubricating fluid" refer to a finished lubrication product comprising a major amount of a base oil plus a minor amount of an additive composition as discussed herein. Such gear fluids are for use in extreme pressure situations such as for transmissions and gear drive components having metal-on-metal contact situations, for instance, in a transmission and/or a limited-slip differential.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having a predominantly hydrocarbon character. Each hydrocarbyl group is independently selected from hydrocarbon substituents, and substituted hydrocarbon substituents containing one or more of halo groups, hydroxyl groups, alkoxy groups, mercapto groups, nitro groups, nitroso groups, amino groups, pyridyl groups, furyl groups, imidazolyl groups, oxygen and nitrogen, and wherein no more than two non-hydrocarbon substituents are present for every ten carbon atoms in the hydrocarbyl group.

As used herein, the term "percent by weight" or "wt %", unless expressly stated otherwise, means the percentage the recited component represents to the weight of the entire composition. All percent numbers herein, unless specified otherwise, is weight percent.

The terms "soluble," "oil-soluble," or "dispersible" used herein may, but does not necessarily, indicate that the compounds or additives are soluble, dissolvable, miscible, or capable of being suspended in the oil in all proportions. The foregoing terms do mean, however, that they are, for instance, soluble, suspendable, dissolvable, or stably dispersible in oil to an extent sufficient to exert their intended effect in the environment in which the oil is employed. Moreover, the additional incorporation of other additives may also permit incorporation of higher levels of a particular additive, if desired.

The term "alkyl" as employed herein refers to straight, branched, cyclic, and/or substituted saturated chain moieties from about 1 to about 200 carbon atoms. The term "alkenyl" as employed herein refers to straight, branched, cyclic, and/or substituted unsaturated chain moieties from about 3 to about 30 carbon atoms. The term "aryl" as employed herein refers to single and multi-ring aromatic compounds that may include alkyl, alkenyl, alkylaryl, amino, hydroxyl, alkoxy, halo substituents, and/or heteroatoms including, but not limited to, nitrogen, and oxygen.

As used herein, the molecular weight is determined by gel permeation chromatography (GPC) using commercially available polystyrene standards (with a Mn of about 180 to about 18,000 as the calibration reference). The molecular weight (Mn) for any embodiment herein may be determined with a gel permeation chromatography (GPC) instrument obtained from Waters or the like instrument and the data processed with Waters Empower Software or the like software. The GPC instrument may be equipped with a Waters Separations Module and Waters Refractive Index detector (or the like optional equipment). The GPC operating conditions may include a guard column, 4 Agilent PLgel columns (length of 300×7.5 mm; particle size of 5μ, and pore size ranging from 100-10000 Å) with the column temperature at about 40° C. Un-stabilized HPLC grade tetrahydrofuran (THF) may be used as solvent, at a flow rate of 1.0 mL/min. The GPC instrument may be calibrated with commercially available polystyrene (PS) standards having a narrow molecular weight distribution ranging from 500-380,000 g/mol. The calibration curve can be extrapolated for samples having a mass less than 500 g/mol. Samples and PS standards can be in dissolved in THF and prepared at concentration of 0.1-0.5 weight percent and used without filtration. GPC measurements are also described in U.S. Pat. No. 5,266,223, which is incorporated herein by reference. The GPC method additionally provides molecular weight distribution information; see, for example, W. W. Yau, J. J. Kirkland and D. D. Bly, "Modern Size Exclusion Liquid Chromatography", John Wiley and Sons, New York, 1979, also incorporated herein by reference.

It is to be understood that throughout the present disclosure, the terms "comprises," "includes," "contains," etc. are considered open-ended and include any element, step, or ingredient not explicitly listed. The phrase "consists essentially of" is meant to include any expressly listed element, step, or ingredient and any additional elements, steps, or ingredients that do not materially affect the basic and novel aspects of the invention. The present disclosure also contemplates that any composition described using the terms, "comprises," "includes," "contains," is also to be interpreted as including a disclosure of the same composition "consisting essentially of" or "consisting of" the specifically listed components thereof.

EXAMPLES

The following examples are illustrative of exemplary embodiments of the disclosure. In these examples, as well as elsewhere in this application, all ratios, parts, and percentages are by weight unless otherwise indicated. It is intended that these examples are being presented for the purpose of illustration only and are not intended to limit the scope of the invention disclosed herein. As used herein, reference to any ASTM or other standardized test in the Examples, description, and/or claims, unless apparent from the context of its use, refers to the version of the test publically available at the time of this application.

Example 1

A lubricating composition including the following phosphorus and nitrogen compounds were evaluated for wear, extreme pressure, friction coefficient, and copper corrosion:

Phosphorus Compound A: 3-[[bis(2-methylpropoxy) phosphinothioy]thio]-2-methyl-propanoic acid (containing about 8 to about 10 wt % phosphorus) and having the following structure:

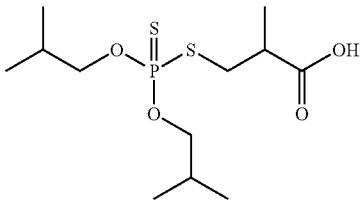

Phosphorus Compound B: N,N-bis(2-hydroxylethyl)aminomethyl phosphonic acid diethyl ester (containing about 11 to about 13 wt % phosphorus) and having the following structure:

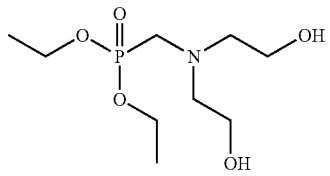

Phosphorus Compound C: methyl octadecyl phosphonate (containing about 7 to about 10 wt % phosphorus) and having the following structure:

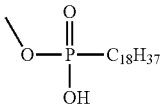

Nitrogen Compound D: 1,1'-((ethane-1,2-diylbis (azanediyl))bis(ethane-2,1-diyl))bis(pyrrolidine-2,5-dione) with each succinimide substituted with an approximately 950 number average molecular weight polyisobutylene (containing about 1.6 to about 2.1 wt % nitrogen) and having the following structure:

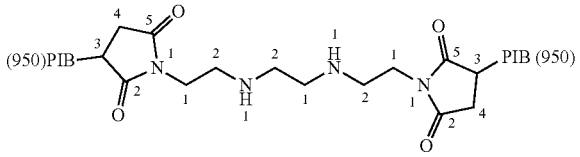

Compounds A, B, C, and/or D were incorporated into a lubricating composition in the weight percent amounts set forth in Table 3 below. Each lubricant also included the same additive package of detergents, dispersants, corrosion inhibitor, antioxidants and anti-foam agents. Each lubricant also includes an API Group I base oil to achieve a KV100 of about 13 to about 15 cSt.

TABLE 3

Lubricant Formulations (wt %) and Performance

| | Inventive | Comparative | | | | | | | |
|---|---|---|---|---|---|---|---|---|---|
| | A | B | C | D | E | F | G | H | I |
| Component A | 0.045 | — | — | — | 0.045 | — | 0.045 | 0.045 | 0.045 |
| Component B | 0.030 | — | — | 0.030 | — | 0.030 | — | 0.030 | 0.030 |
| Component C | 0.017 | — | 0.017 | — | — | 0.017 | 0.017 | — | 0.017 |
| Component D | 0.350 | 0.350 | 0.350 | 0.350 | 0.350 | 0.350 | 0.350 | 0.350 | — |
| 4 ball wear, 40 kg, mwsd (mm) | 0.41 | 0.44 | 0.46 | 0.47 | 0.38 | 0.46 | 0.45 | 0.46 | 0.30 |
| 4 ball Weld LWI | 53.6 | 47.4 | 54.6 | 44.2 | 45.0 | 52.7 | 45.0 | 44.4 | 43.9 |
| HFRR friction coefficient | 0.130 | 0.144 | 0.142 | 0.128 | 0.124 | 0.142 | 0.121 | 0.144 | 0.147 |
| Copper Corrosion, 100 C., 3 hrs (Rating) | 1B | 1B | 1B | 1B | 1B | 1B | 1B | 1B | 2C |

As used herein, the 4 ball wear test was run according to ASTM D4172 using a 40 kg load, 75° C., 1800 rpm, for 60 minutes with reported results being a mean wear scar diameter (mm). The 4 ball LWI extreme pressure tests were run according to ASTM D2783 with Load Wear Index (LWI) reported. The High Frequency Reciprocating Rig (HFRR) friction coefficient was conducted at 400 g load, 20 Hz, 80° C. for 3 minutes with Friction coefficient reported (as described in SAE paper 982503 except using 80° C., which is incorporated herein by reference). Copper Corrosion was determined according to ASTM D130 with testing for 3 hours at 100° C. and with reported rating determined via a comparator chart.

As shown in Table 3 above, Comparative Samples B to I, only including 1, 2, or 3 of the noted compounds, failed one or more of the performance tests (shown by underlining). Only when all 4 of compounds A, B, C, and D were included in the lubricant was the fluid able to pass all for performance tests.

When the fluid including the nitrogen compound, but did not contain any phosphorus compounds (e.g., Comparative Example B), the fluid had a poor a wear scar. When the fluid included the nitrogen compound, but only one of the phosphorus compounds (e.g., Comparative Examples C, D, or E), the fluid had poor wear scar, extreme pressure, and/or friction. When the fluid included the nitrogen compound with only two of the phosphorus compounds (e.g., Comparative Examples F, G, or H), the fluids failed wear, extreme pressure, and/or friction. If the fluid included all three phosphorus compounds but not the nitrogen compound (e.g., Comparative I), then the fluid failed extreme pressure and copper corrosion. Only with the inventive sample including all three phosphorus compounds and the nitrogen compound was the fluid able to pass each of the four performance tests.

It is noted that, as used in this specification and the appended claims, the singular forms "a," "an," and "the," include plural referents unless expressly and unequivocally limited to one referent. Thus, for example, reference to "an antioxidant" includes two or more different antioxidants. As used herein, the term "include" and its grammatical variants are intended to be non-limiting, such that recitation of items in a list is not to the exclusion of other like items that can be substituted or added to the listed items.

For the purposes of this specification and appended claims, unless otherwise indicated, all numbers expressing quantities, percentages or proportions, and other numerical values used in the specification and claims, are to be understood as being modified in all instances by the term "about." Accordingly, unless indicated to the contrary, the numerical parameters set forth in the following specification and attached claims are approximations that can vary depending upon the desired properties sought to be obtained by the present disclosure. At the very least, and not as an attempt to limit the application of the doctrine of equivalents to the scope of the claims, each numerical parameter should at least be construed in light of the number of reported significant digits and by applying ordinary rounding techniques.

It is to be understood that each component, compound, substituent or parameter disclosed herein is to be interpreted as being disclosed for use alone or in combination with one or more of each and every other component, compound, substituent or parameter disclosed herein.

It is further understood that each range disclosed herein is to be interpreted as a disclosure of each specific value within the disclosed range that has the same number of significant digits. Thus, for example, a range from 1 to 4 is to be interpreted as an express disclosure of the values 1, 2, 3 and 4 as well as any range of such values.

It is further understood that each lower limit of each range disclosed herein is to be interpreted as disclosed in combination with each upper limit of each range and each specific value within each range disclosed herein for the same component, compounds, substituent or parameter. Thus, this disclosure to be interpreted as a disclosure of all ranges derived by combining each lower limit of each range with each upper limit of each range or with each specific value within each range, or by combining each upper limit of each range with each specific value within each range. That is, it is also further understood that any range between the endpoint values within the broad range is also discussed herein. Thus, a range from 1 to 4 also means a range from 1 to 3, 1 to 2, 2 to 4, 2 to 3, and so forth.

Furthermore, specific amounts/values of a component, compound, substituent or parameter disclosed in the description or an example is to be interpreted as a disclosure of either a lower or an upper limit of a range and thus can be combined with any other lower or upper limit of a range or specific amount/value for the same component, compound, substituent or parameter disclosed elsewhere in the application to form a range for that component, compound, substituent or parameter.

While particular embodiments have been described, alternatives, modifications, variations, improvements, and substantial equivalents that are or can be presently unforeseen can arise to applicants or others skilled in the art. Accordingly, the appended claims as filed and as they can be amended are intended to embrace all such alternatives, modifications variations, improvements, and substantial equivalents.

What is claimed is:

1. A lubricating composition comprising:

(i) a base oil of lubricating viscosity;

(ii) an amount of phosphorus provided from three phosphorus compounds including (iia) a first phosphorus compound including an ashless, dialkyl dithiophosphate of Formula I, or a salt thereof:

(Formula I)

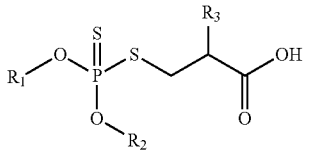

wherein $R_1$ and $R_2$ are, independently, a C3 to C8 linear or branched alkyl group, and $R_3$ is hydrogen or a methyl group, and wherein the first phosphorus compound provides about 5 to about 75 ppm of phosphorus to the lubricating composition;

(iib) a second phosphorus compound including an amino alkyl phosphonate of Formula II or cyclic derivatives thereof:

(Formula II)

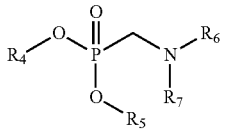

wherein $R_4$ and $R_5$ are, independently, a C1 to C4 linear or branched alkyl group, and $R_6$ and $R_7$ are, independently a C1 to C4 hydroxyalkyl group, wherein the second phosphorus compound provides about 10 to about 65 ppm of phosphorus to the lubricating composition; and (iic) a third phosphorus compound including a hydrocarbyl phosphonate monoester of Formula III:

(Formula III)

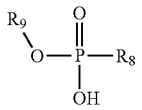

wherein $R_8$ is a $C_{12}$ to $C_{30}$ hydrocarbyl group and $R_9$ is a methyl group, an ethyl group, a propyl group, or an isopropyl group, wherein the third phosphorus compound provides about 5 to about 40 ppm of phosphorus to the lubricating composition; and wherein the first, the second, and the third phosphorus compounds provide a total of about 30 ppm to about 200 ppm phosphorus to the lubricating composition;

(iii) an amount of nitrogen provided by a nitrogen-containing polyisobutylene succinimide with a number average molecular weight of the polyisobutylene substituent of about 500 to about 2500 g/mol when determined by gel permeation chromatography using polystyrene as a standard and providing about 30 ppm to about 105 ppm weight percent of nitrogen to the lubricating composition.

2. The lubricating composition of claim 1, wherein the first phosphorus compound is 3-[[bis(2-methylpropoxy) phosphinothioyl]thio]-2-methyl-propanoic acid.

3. The lubricating composition of claim 1, wherein the second phosphorus compound is N,N-bis(2-hydroxylethyl) aminomethyl phosphonic acid diethyl ester.

4. The lubricating composition of claim 1, wherein the third phosphorus compound is methyl octadecyl phosphonate.

5. The lubricating composition of claim 1, wherein the lubricating composition exhibits a mean wear scar of about 0.5 mm or less pursuant to ASTM D4172 (40 kgf), a load wear index of about 46 or greater pursuant to ASTM D2783, a friction coefficient as measured using a high frequency reciprocating rig (HFRR) of greater than about 0.128 when using a 400 gram load, 20 Hz, 80° C. for 3 minutes, and a copper corrosion tarnishing rating of 2b or better when evaluated pursuant to ASTM D130 for 3 hours at 100° C.

6. The lubricating composition of claim 1, wherein about 30 to about 45 weight percent of the total phosphorus is provided by the first phosphorus compound, about 35 to about 40 weight percent of the total phosphorus is provided by the second phosphorus compound, and about 20 to about 30 weight percent of the total phosphorus is provided by the third phosphorus compound.

7. The lubricating composition of claim 1, wherein greater than 50 weight percent of the phosphorus is provided by the second and third phosphorus compounds combined.

8. The lubricating composition of claim 1, wherein the lubricating composition has a ratio of phosphorus from the three phosphorus compounds to nitrogen from the nitrogen-substituted long chain alkenyl succinimide of about 1:1 to about 2.2:1.

9. The lubricating composition of claim 1, wherein the nitrogen-substituted long chain alkenyl succinimide includes compounds having a structure of Formula IV:

(Formula IV)

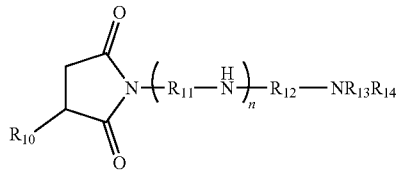

wherein $R_{10}$ is a polyisobutylene having a number average molecular weight of about 500 to about 1200 g/mol;

$R_{11}$ and $R_{12}$ are, independently, a divalent $C_1$-$C_6$ alkylene;

each of $R_{13}$ and $R_{14}$, independently, is hydrogen, $C_1$-$C_6$ alkyl, or together with the N to which they are attached form a 5- or 6-membered ring optionally fused with one or more aromatic or non-aromatic rings; and n is an integer from 0 to 8.

10. The lubricant composition of claim 9, wherein $R_{13}$ and $R_{14}$ together with the N to which they are attached form a succinimide moiety of Formula V (Formula V)

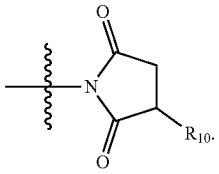

11. A method of lubricating a transmission, gearbox, and/or clutch, the method comprising:

lubricating a transmission, a gearbox, and/or a clutch component with a lubricating composition; and wherein the lubricating composition includes (i) a base oil of lubricating viscosity;

(ii) an amount of phosphorus provided from three phosphorus compounds including (iia) a first phosphorus compound including an ashless, dialkyl dithiophosphate of Formula I, or a salt thereof:

(Formula I)

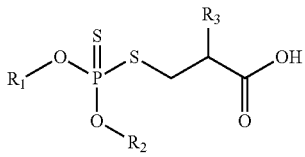

wherein $R_1$ and $R_2$ are, independently, a C3 to C8 linear or branched alkyl group, and $R_3$ is hydrogen or a methyl group, wherein the first phosphorus compound provides about 5 to about 75 ppm of phosphorus to the lubricating composition;

(iib) a second phosphorus compound including an amino alkyl phosphonate of Formula II or cyclic derivatives thereof:

(Formula II)

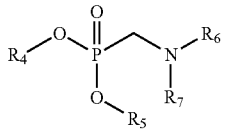

wherein $R_4$ and $R_5$ are, independently, a C1 to C4 linear or branched alkyl group, and $R_6$ and $R_7$ are, independently a C1 to C4 hydroxyalkyl group, wherein the second phosphorus compound provides about 10 to about 65 ppm of phosphorus to the lubricating composition; and (iic) a third phosphorus compound including a hydrocarbyl phosphonate monoester of Formula III:

(Formula III)

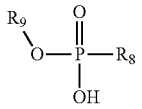

wherein $R_8$ is a $C_{12}$ to $C_{30}$ hydrocarbyl group and $R_9$ is a methyl group, an ethyl group, a propyl group, or an isopropyl group, wherein the third phosphorus compound provides about 5 to about 40 ppm of phosphorus to the lubricating composition; and wherein the first, the second, and the third phosphorus compounds provide a total of about 30 ppm to about 200 ppm phosphorus to the lubricating composition;

(iii) an amount of nitrogen provided by a nitrogen-containing polyisobutylene succinimide with a number average molecular weight of the polyisobutylene substituent of about 500 to about 2,500 g/mol when determined by gel permeation chromatography using polystyrene as a standard and providing about 30 ppm to about 105 ppm weight percent of nitrogen to the lubricating composition.

12. The method of claim 11, wherein the first phosphorus compound is 3-[[bis(2-methylpropoxy)phosphinothioyl]thio]-2-methyl-propanoic acid.

13. The method of claim 11, wherein the second phosphorus compound is N,N-bis(2-hydroxylethyl)aminomethyl phosphonic acid diethyl ester.

14. The method of claim 11, wherein the third phosphorus compound is methyl octadecyl phosphonate.

15. The method of claim 11, wherein the lubricating composition exhibits a mean wear scar of about 0.5 mm or less pursuant to ASTM D4172 (40 kgf), a load wear index of about 46 or greater pursuant to ASTM D2783, a friction coefficient as measured using a high frequency reciprocating rig (HFRR) of greater than about 0.128 when using a 400 gram load, 20 Hz, 80° C. for 3 minutes, and a copper corrosion tarnishing rating of 2b or better when evaluated pursuant to ASTM D130 for 3 hours at 100° C.

16. The method of claim 11, wherein about 30 to about 45 weight percent of the total phosphorus is provided by the first phosphorus compound, about 35 to about 40 weight percent of the total phosphorus is provided by the second phosphorus compound, and about 20 to about 30 weight percent of the total phosphorus is provided by the third phosphorus compound.

17. The method of claim 11, wherein greater than 50 weight percent of the phosphorus is provided by the second and third phosphorus compounds combined.

18. The method of claim 11, wherein the lubricating composition has a ratio of phosphorus from the three phosphorus compounds to nitrogen from the nitrogen-substituted long chain alkenyl succinimide of about 1:1 to about 2.2:1.

19. The method of claim 11, wherein the nitrogen-substituted long chain alkenyl succinimide includes compounds having a structure of Formula IV:

(Formula IV)

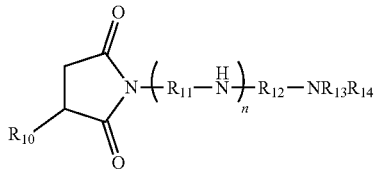

wherein $R_{10}$ is a polyisobutylene having a number average molecular weight of about 500 to about 1200 g/mol;

$R_{11}$ and $R_{12}$ are, independently, a divalent $C_1$-$C_6$ alkylene;

each of $R_{13}$ and $R_{14}$, independently, is hydrogen, $C_1$-$C_6$ alkyl, or together with the N to which they are attached form a 5- or 6-membered ring optionally fused with one or more aromatic or non-aromatic rings; and n is an integer from 0 to 8.

20. The method of claim 19, wherein R13 and $R_{14}$ together with the N to which they are attached form a succinimide moiety of Formula V (Formula V)

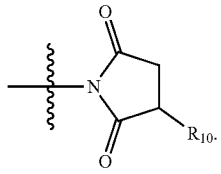

* * * * *